US006106107A

United States Patent [19]

Sheinman

[11] Patent Number: 6,106,107

[45] Date of Patent: Aug. 22, 2000

[54] APPARATUS AND METHOD FOR MULTI-JET GENERATION OF HIGH VISCOSITY FLUID AND CHANNEL CONSTRUCTION PARTICULARLY USEFUL THEREIN

[75] Inventor: Yhoshua Sheinman, Ra'anana, Israel

[73] Assignee: Jemtex Ink Jet Printing Ltd., Tel Aviv, Israel

[21] Appl. No.: 08/953,208

[22] Filed: Oct. 17, 1997

Related U.S. Application Data

[63] Continuation-in-part of application No. 08/734,299, Oct. 21, 1996, Pat. No. 5,969,733.

[51] Int. Cl.[7] ..... B41J 2/14; B41J 2/165

[52] U.S. Cl. ..... 347/75; 347/47

[58] Field of Search ..... 347/5, 6, 7, 10, 347/20, 22, 28, 29, 30, 35, 36, 40, 47, 75

[56] References Cited

U.S. PATENT DOCUMENTS

| | | | |
|---|---|---|---|
| 4,492,968 | 1/1985 | Lee et al. | 347/10 |
| 4,542,386 | 9/1985 | Delligatii et al. . | |
| 4,549,188 | 10/1985 | Shackleton . | |
| 4,550,325 | 10/1985 | Viola . | |
| 4,590,483 | 5/1986 | Ragnault | 347/6 |
| 4,827,287 | 5/1989 | Braun et al. . | |
| 5,184,147 | 2/1993 | MacLane et al. . | |
| 5,408,255 | 4/1995 | Emerson | 347/80 |
| 5,502,474 | 3/1996 | Katerberg | 347/75 |
| 5,677,718 | 10/1997 | Crawford et al. | 347/92 |
| 5,786,829 | 7/1998 | Pasciak, Jr. et al. | 347/28 |

*Primary Examiner*—N. Le
*Assistant Examiner*—Anh T. N. Vo
*Attorney, Agent, or Firm*—Ladas & Parry

[57] ABSTRACT

A continuous jet module, apparatus, and method are described for printing with a high viscosity printing fluid having a viscosity of 10 to 100 centipoise. The module includes a housing having a printing fluid reservoir for feeding the high viscosity printing fluid to a plurality of channels. The reservoir has a first longitudinal direction and includes a plurality of openings in a second direction. Each channel is disposed in one of the corresponding openings, and each channel receives the high viscosity printing fluid from the reservoir through its corresponding opening and generates therefrom a continuous jet of high viscosity printing fluid.

19 Claims, 20 Drawing Sheets

FIG.1A
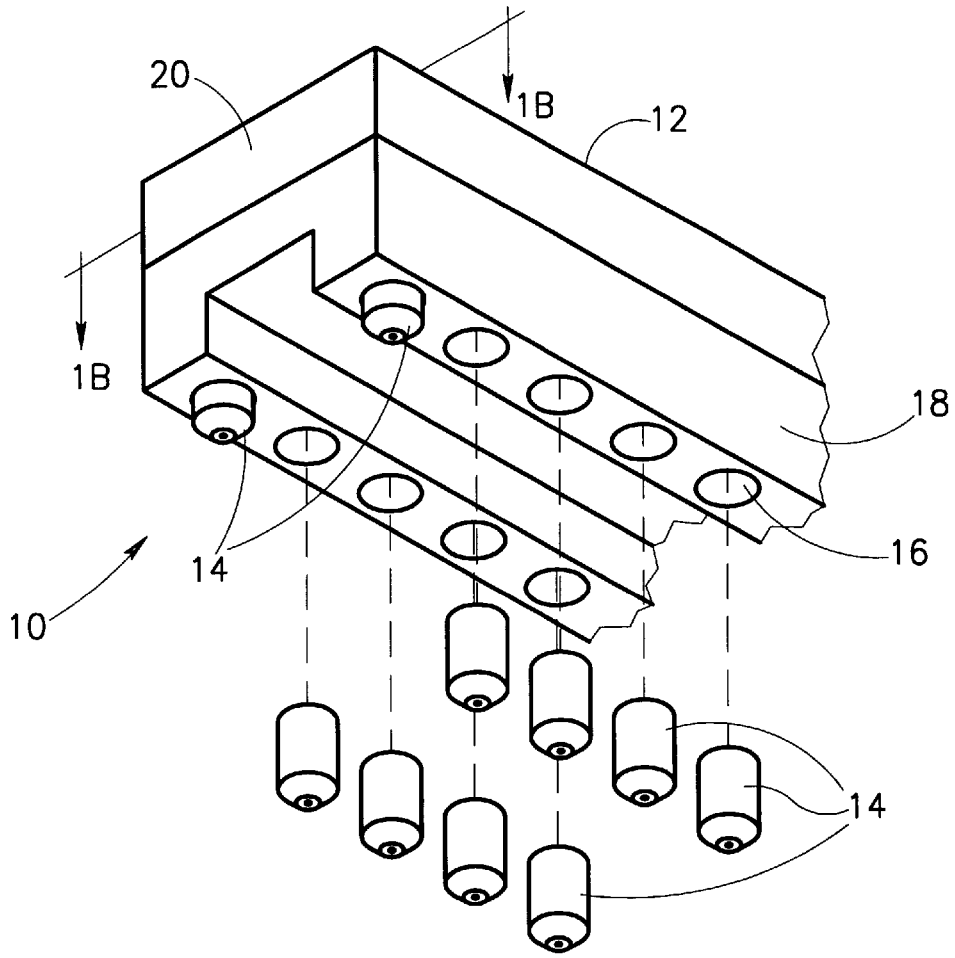
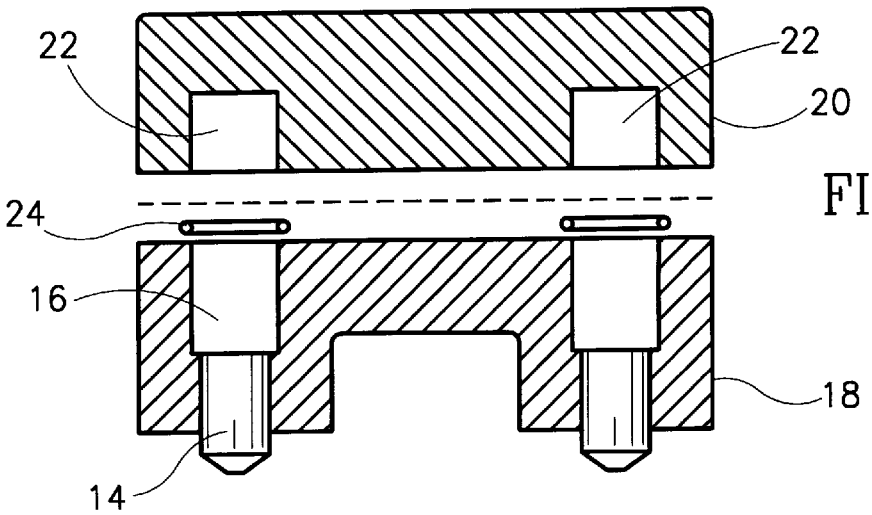
FIG.1B

APPARATUS AND METHOD FOR MULTI-JET GENERATION OF HIGH VISCOSITY FLUID AND CHANNEL CONSTRUCTION PARTICULARLY USEFUL THEREIN

RELATED APPLICATION

The present application is for a continuation-in-part to application Ser. No. 08/734,299, filed Oct. 21, 1996, which application is U.S. Pat. No. 5,969,733.

FIELD OF THE INVENTION

The present invention relates to apparatus and to a method for printing, particularly with high viscosity printing fluids.

BACKGROUND OF THE INVENTION

Ink jet printing systems are well known in the art. Generally speaking, ink jet printing systems fall into two main categories—continuous-jet and drop-on-demand.

In both categories, droplets are formed by forcing a printing fluid, or ink, through a nozzle. Hence, the ink-jet devices typically include a multitude of very small diameter nozzles. Drop-on-demand systems typically use nozzles having openings ranging from 30 to 100 $\mu$m while continuous-jet systems typically use nozzles having openings ranging from only 10–35 $\mu$m.

One deficiency of prior art continuous jet ink-jet systems is that they are not suitable for printing and coating with high viscosity printing and coating fluids, respectively. However, printing with high viscosity printing fluids and coating of printed substrates with a high viscosity coating fluid are desired for many applications, such as on textiles and for overprint coatings, respectively.

SUMMARY OF THE INVENTION

It is therefore an object of the present invention to provide a continuous-jet apparatus and method for printing and coating high viscosity printing fluids and coating fluids, respectively.

The term high viscosity fluid as used throughout the description and claims, means a printing ink or coating liquid having a viscosity in the range of 10–100 centipoise. The term printing is used to indicate both printing and coating and when applicable combinations of both.

According to one aspect of the present invention, there is provided a jet module for discharging a high viscosity printing fluid onto a substrate, comprising: (a) a housing including a printing fluid reservoir for the high viscosity printing fluid, the reservoir having a longitudinal axis in a first: direction and including a plurality of openings oriented in a second direction; (b) a plurality of directional channels defining a plurality of discharge nozzles, each channel having one end mounted in a corresponding one of the openings for receiving the high viscosity printing fluid from the reservoir, and an opposite end terminating in a discharge nozzle through which a continuous jet of the high viscosity printing fluid is discharged onto the substrate; and (c) a holder for each channel for mounting the channel in a respective one of the openings, each holder including: a mounting section for mounting the holder in the housing opening, a holder section for receiving the channel, and an angularly displaceable juncture section permitting the holder section to be angularly displaced with respect to the mounting section.

According to a still further aspect of the present invention, there is provided a continuous jet printing apparatus including a printing module as defined above for discharging a plurality of high viscosity fluid droplets towards a substrate, a charging unit, and a deflecting unit, for charging and deflecting the fluid droplets with respect to said substrate.

According to a still further aspect of the present invention, there is provided apparatus as defined above, and further including a cleaning unit comprising: a plurality of injection nozzles for injecting a cleaning fluid wet the ink discharge nozzles; a carriage movable to a plurality of positions with respect to said discharge nozzles; and a tray carried by said carriage and movable thereby to a first position underlying said discharge nozzles to receive cleaning fluid draining therefrom, and to a second position laterally of said discharge nozzles to permit the cleaning fluid discharged therefrom to reach said substrate.

According to a still further aspect of the present invention, there is provided a method for printing, comprising: forming at least one continuous jet of high viscosity printing fluid having a viscosity of 10 to 100 centipoise; and applying selected fluid droplets of said continuous jet of high viscosity printing fluid onto a printing substrate.

BRIEF DESCRIPTION OF THE DRAWINGS

The present invention will be understood and appreciated more fully from the following detailed description taken in conjunction with the appended drawings in which:

FIG. 1A is a schematic bottom up view isometric illustration of an exploded view of a printing module, constructed and operative in accordance with a first embodiment of the present invention;

FIG. 1B is a schematic cross section illustration through lines I—I in FIG. 1A;

DETAILED DESCRIPTION OF THE PREFERRED EMBODIMENTS

Figure 2A:
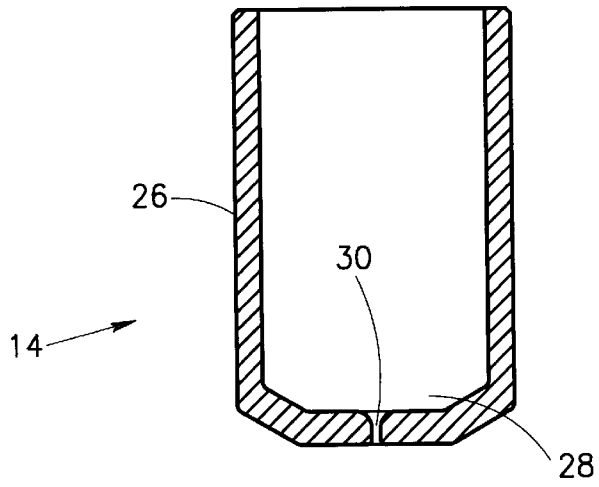
FIG. 2A is a cross section illustrations of one channel of the plurality of channels of the printing module of the present invention.

Reference is now made to FIGS. 1A through 2B which schematically illustrate a module, generally referenced 10, constructed in accordance with a preferred embodiment of the present invention for printing with a high viscosity printing fluid.

Printing module 10 comprises a housing 12 and a plurality of directional channels 14. In operation, high viscosity printing fluid is provided from a printing fluid reservoir in housing 12 to each channel 14 which forms a continuous jet therefrom of high viscosity printing droplets which are applied to a printing substrate or deflected as described in detail hereinbelow.

As best seen from FIG. 1*b,* housing 12 comprises a channels plate 18 formed with generally vertical openings 16 therethrough, and a channels plate cover 20 formed with generally horizontally oriented longitudinal recess 22 therealong. In the nonlimiting illustrated embodiment, channels plate cover 20 includes two recesses 22 each disposed above a corresponding line of openings 16 in channels plate 18 in which corresponding channels 14 are disposed at substantially equally spaced distances.

In the illustrated embodiment, recesses 22 form a printing fluid reservoir once channels plate cover 20 is assembled with channels plate 18. Preferably, an elongated O-ring 24 is disposed intermediate the inlet of holes 16 and recess 22 of channels plate cover 20.

Figure 2B:
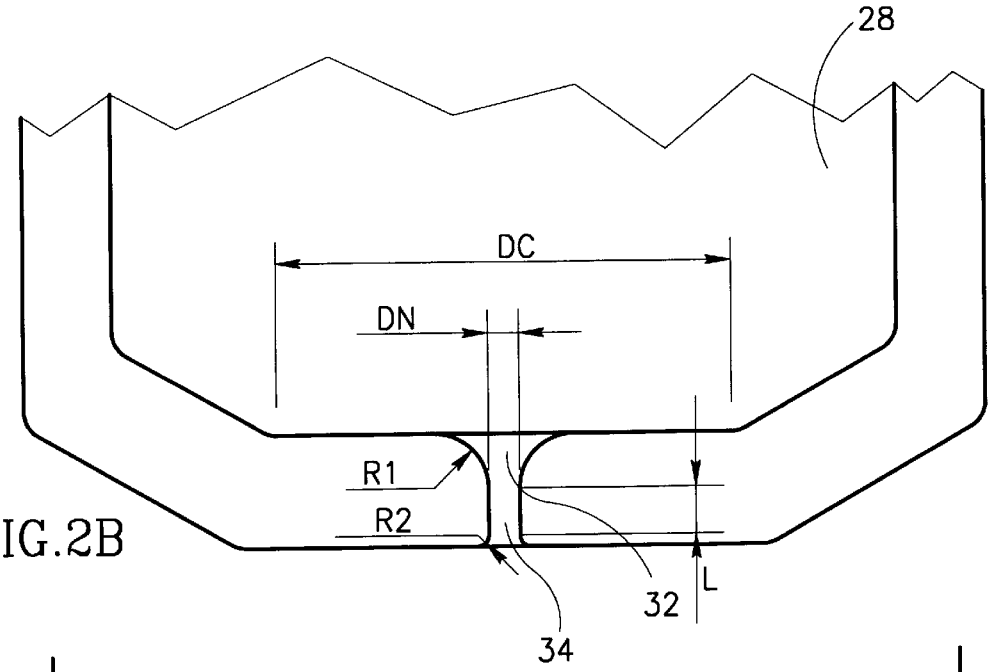
FIGS. 2B and 2C are detailed illustration of two alternative nozzles of the channel of FIG. 2A.

As best seen in FIGS. 2A and 2B, each channel 14 includes a channel body 26 having a generally cylindrical shape, a channel narrowing 28 downstream of channel body 26, and a channel nozzle 30 downstream of channel narrowing 28.

A particular feature of the present invention is that channel 14 is configured to enable discharge of high viscosity printing fluid in the range of 10–100 centipoise and employs a particular geometric structure and dimensional relationships between different parts thereof for this purpose.

In the preferred embodiment of FIG. 2B, channel narrowing 28 has a generally truncated conical shape which forms an angle of about 120 degrees, the length of the truncated end being denoted DC, for converging the high viscosity printing fluid into nozzle 30. Nozzle 30 includes a second narrowing having an inlet 32 of generally partially circular shape and of a curvature defined by radius R1, a nozzle aperture 34 for discharging the printing jet formed in channel 14 and having a diameter denoted by DN, and a nozzle outlet of partially circular shape of a curvature defined by radius R2.

In the preferred embodiment of FIG. 2B, a preferred nozzle aspect ratio, defined by the ratio between DN and L (the length of nozzle aperture 32) is 1:1.8 to 1:6, preferably 1:1.8 to 1:4.

Additional preferred geometrical characteristics of channel 14 are as follows. First, the diameter of narrowing 28 in its truncated downstream end (DC) is an order of magnitude larger than DN. Second, R1 is about five times larger than R2 and preferably larger by 20 percent than DN.

The channel of FIG. 2B is particularly suitable for channels having a DN which is equal or larger than 60 microns. Typical working parameters for a printing module with the channels of FIG. 2B for printing high viscosity fluids having a viscosity of 10–100 centipoise are as follows. Channels pressure is between 3–8 bars, preferably 4–6 bars for viscosity closer to 10 cps, and 7–8 bars for viscosity closer to 100 cps; jet speed is 11–20 meters/second; Reynolds number is between 30 and 65; and drop rate is between 25 and 72 Khz.

A particular feature of the present invention is that the geometric characteristics of the channels are optimized in accordance with the diameter of DN. For DN smaller than 60 microns, the channels are configured as illustrated in FIG. 2C to which reference is now made.

Figure 2C:
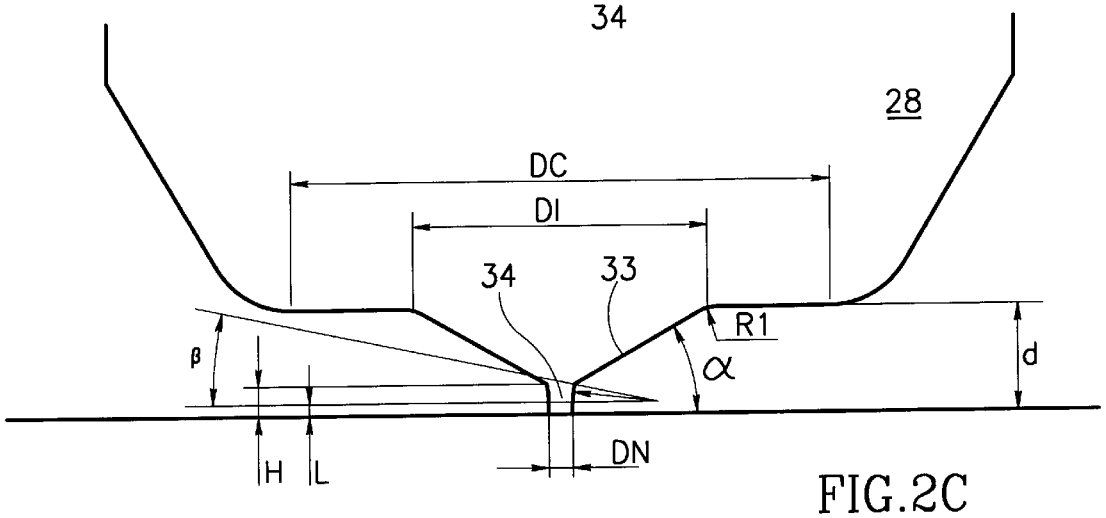

In the channel of FIG. 2C, narrowing 28 is generally similar to that of the channel of FIG. 2B. The second narrowing includes a second truncated cone indicated by 33 connected to the truncated downstream end of narrowing 28 in a rounded edge having a radius R1. Downstream of said second truncated cone (having an angle $\alpha$) is channel nozzle 34 (having a diameter DN) and connected thereto in a slightly rounded edge (having an angle $\beta$).

The channel of FIG. 2C is particularly suitable for DN smaller than 60 microns and for applying printing fluids having a viscosity between 10–45 cps. Preferred operational parameters of the channels of FIG. 2C are similar to those of the channel of FIG. 2B.

Figure 3:
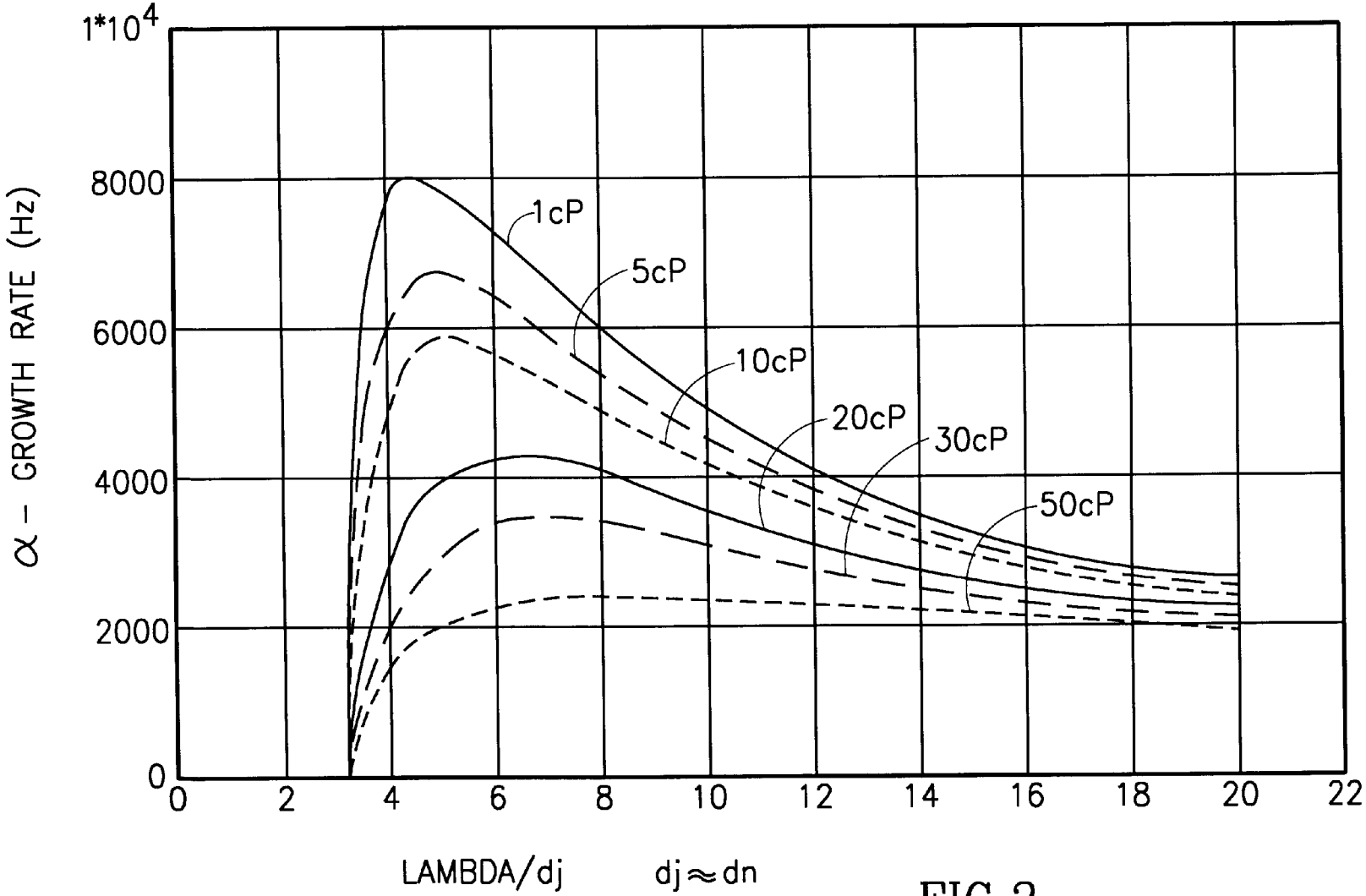
FIG. 3 is a graph illustrating the growth rate of the ink drops (Y-Axis) as function of lambda\dj which is the normalized wavelength (X-Axis)

Reference is also made to FIG. 3 which is a graph depicting the printing fluid droplets growth rate (Y-axis) at 35 dyne/cm as a function of the normalized wavelength (X-axis) which is the ratio between the length between consecutive droplets (lambda) and the nozzle aperture diameter 34 (DN). As clearly seen from FIG. 3, the preferred normalized wavelength for printing fluid droplets growth rate is when lambda\DN is greater than 3, and more preferably between 4–6.

A preferred method of constructing a printing apparatus comprising at least one printing module 10 is now described with reference to FIGS. 4A–4F which pictorially illustrate the construction steps, and FIG. 5 which illustrates the method in block diagram form.

Figure 4A:
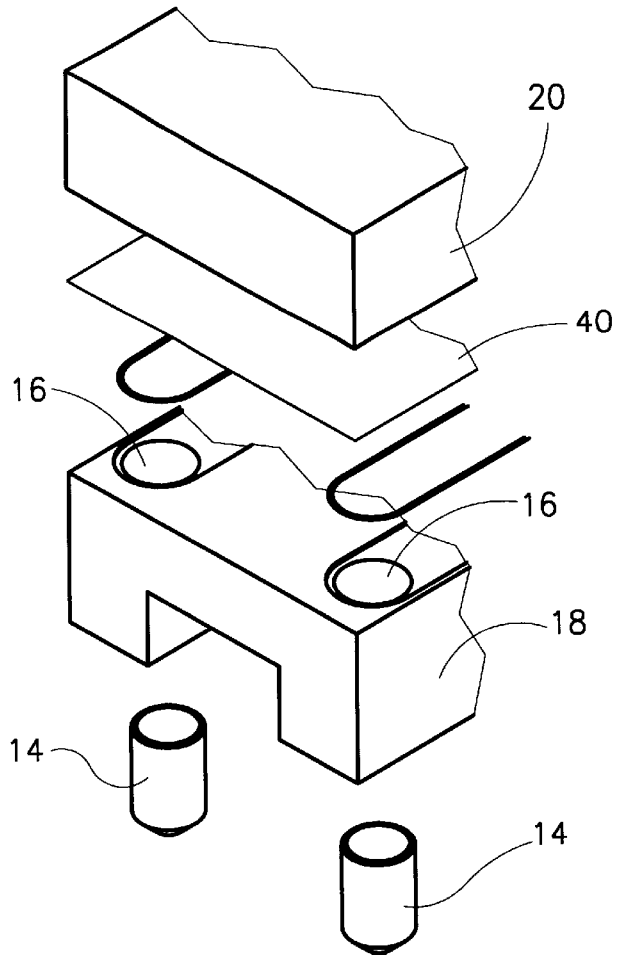
FIGS. 4A–4F are schematic isometric illustrations which illustrate a preferred method for constructing a printing apparatus constructed from a plurality of printing channels of the present invention.
Figure 5:
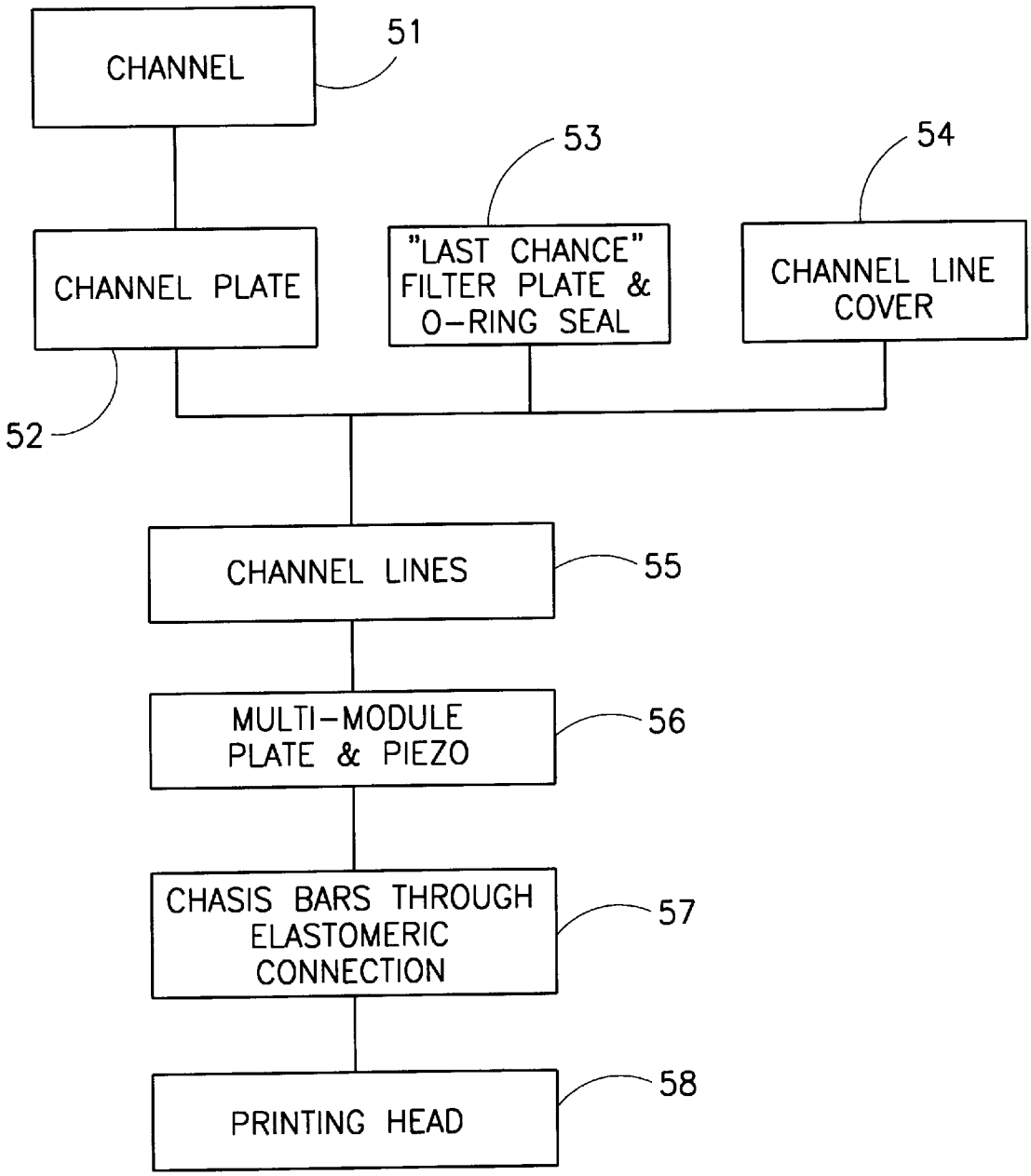
FIG. 5 is a block diagram illustration of the method illustrated in FIGS. 4A–4F.
Figure 6:
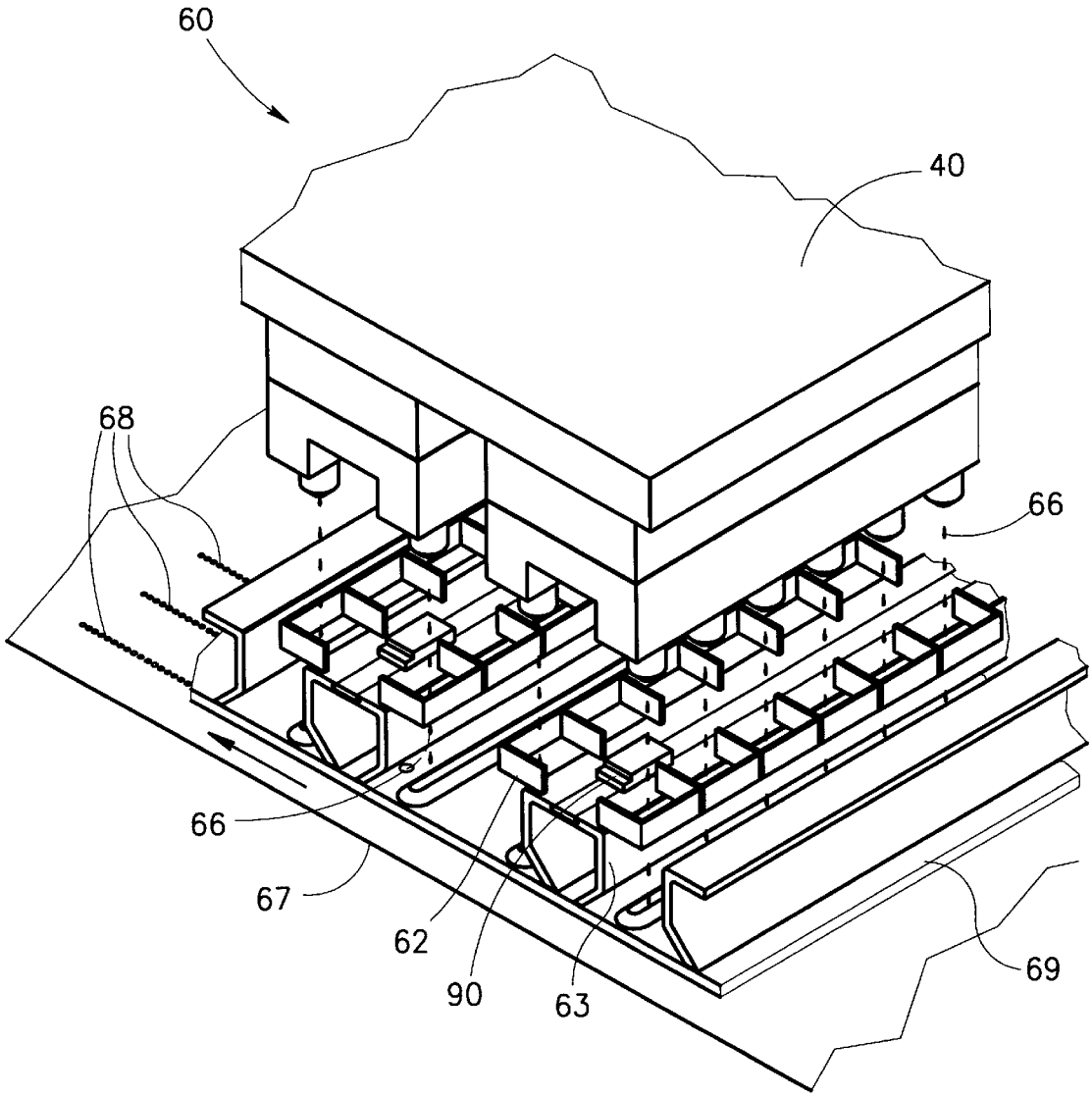
FIG. 6 is a schematic isometric illustration of a printing apparatus, constructed in accordance with a preferred embodiment of the present invention.

In step 51 (FIG. 5) as shown in FIG. 4A, each channel 14 is disposed in a corresponding opening 16 of channel plate 18. In a preferred embodiment, channels 14 are made of sintered ceramics; and channel plate 18, as well as channel plates cover 20, are made of any suitable material, such as brass.

Figure 4B:
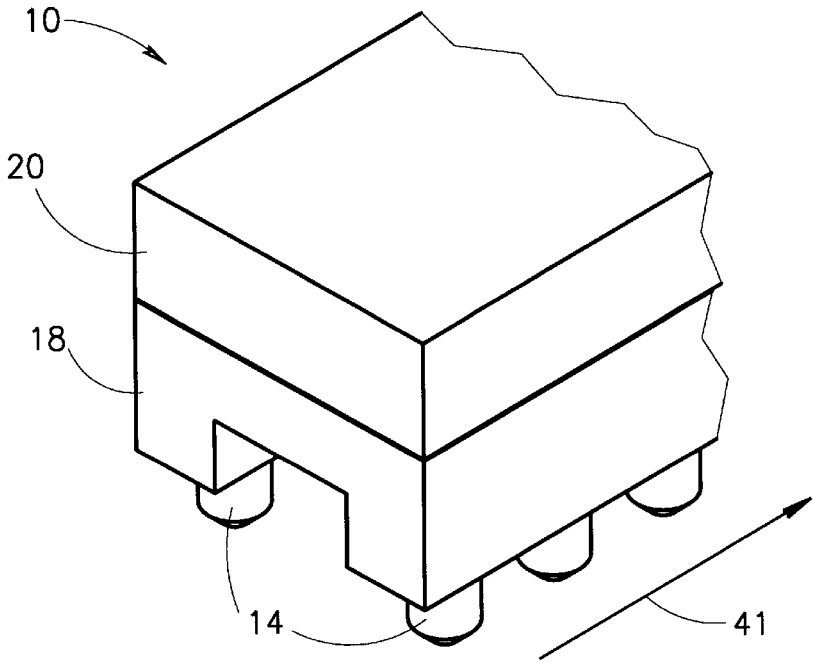

In steps 52, 53 and 54; the inlet of each opening 16 of channels plate 18 is covered with the elongated O-ring seal 24 and preferably also with a common filter 40, known in the art as last chance filter, and closed by channels plate cover 20 to provide printing module 10 as illustrated in FIG. 4B. Printing module 10 includes a plurality of channel lines 41, each operative to apply a line of a printing fluid on a printing substrate. In the nonlimiting illustrated embodiment, printing module 10 includes two channel lines 41.

Figure 4C:
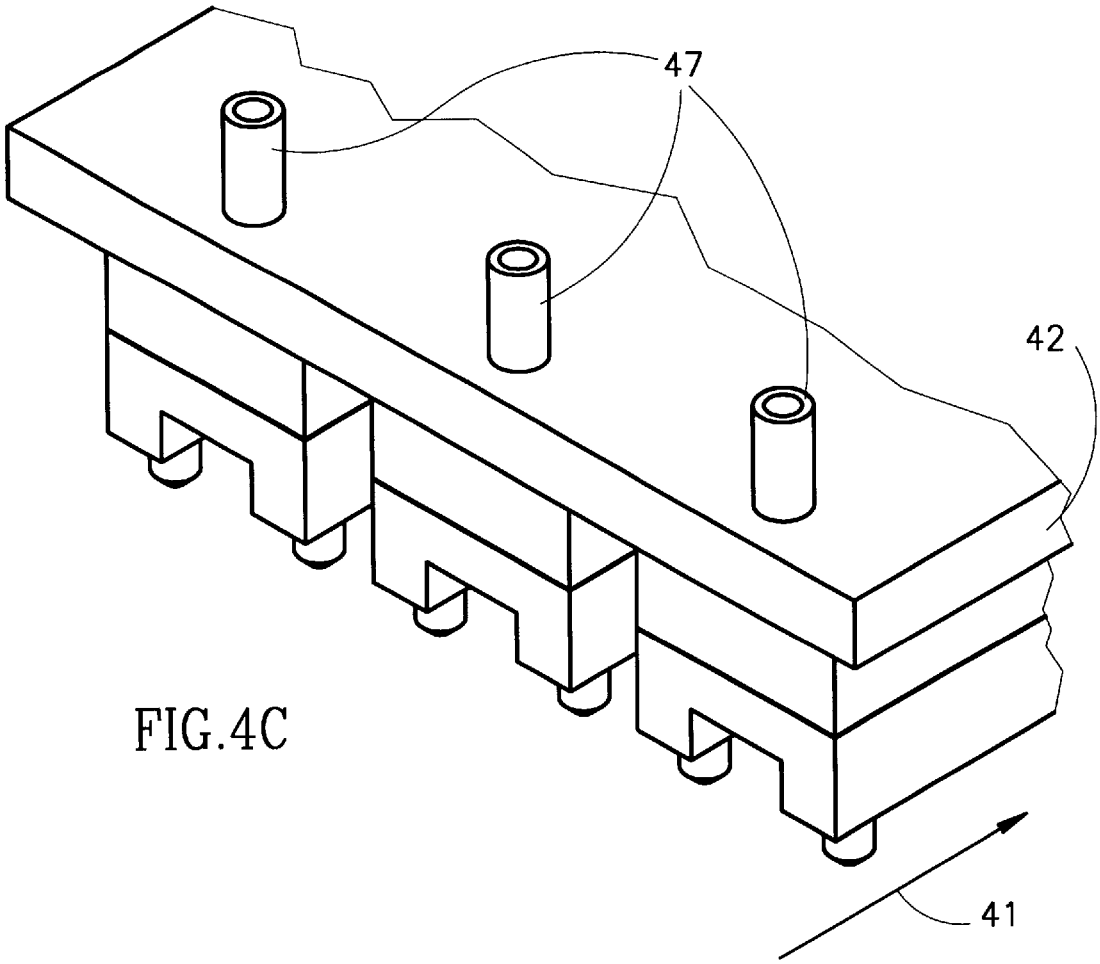
Figure 4D:
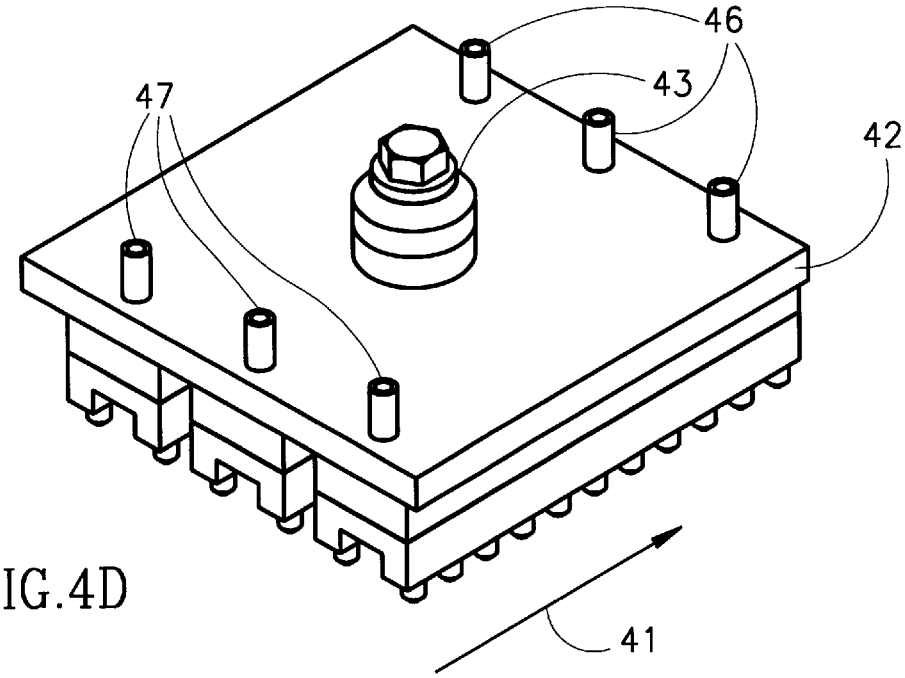

At least one printing module and preferably a plurality of printing modules 10 are assembled to form channel lines as indicated by step 55 and illustrated in FIG. 4C. Printing modules 10 are assembled so as to generate a plurality of channel lines 41 via a printing apparatus multi-module plate 42 to which a common piezo electric transducer 43 is connected as illustrated in FIG. 4D and indicated by step 56.

Figure 8:
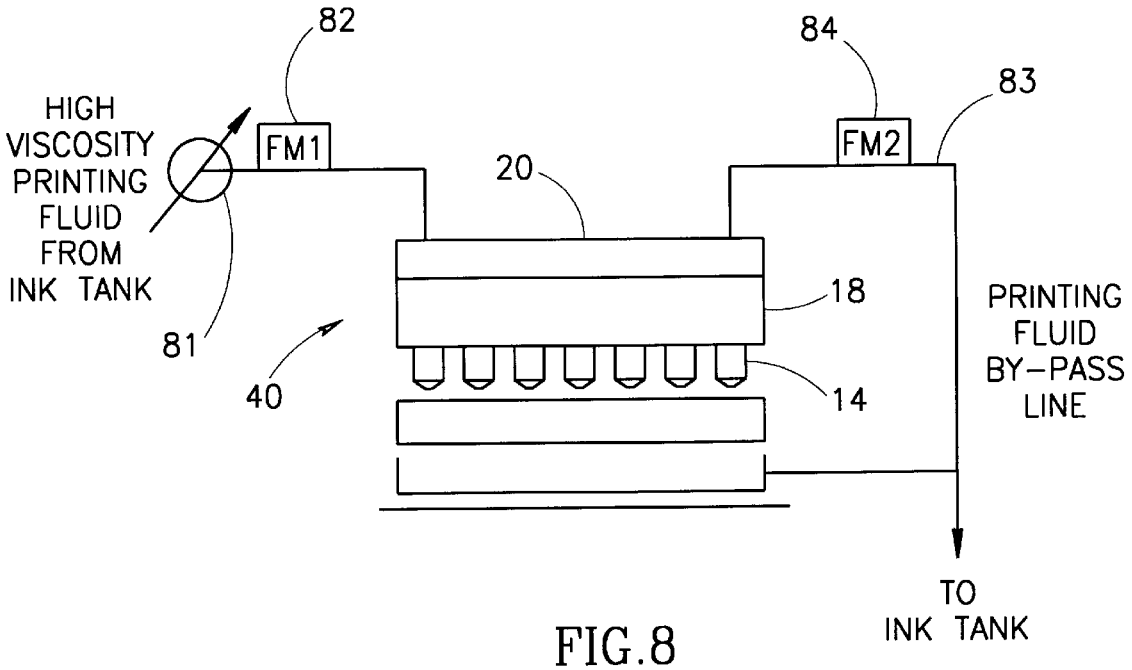
FIG. 8 is a schematic pictorial illustration of the viscosity control system of the printing apparatus of FIG. 6.

In the illustrated embodiment, each printing module 10 has an inlet 46 and an outlet 47 which are controlled as described in detail with reference to FIG. 8.

Figure 4E:
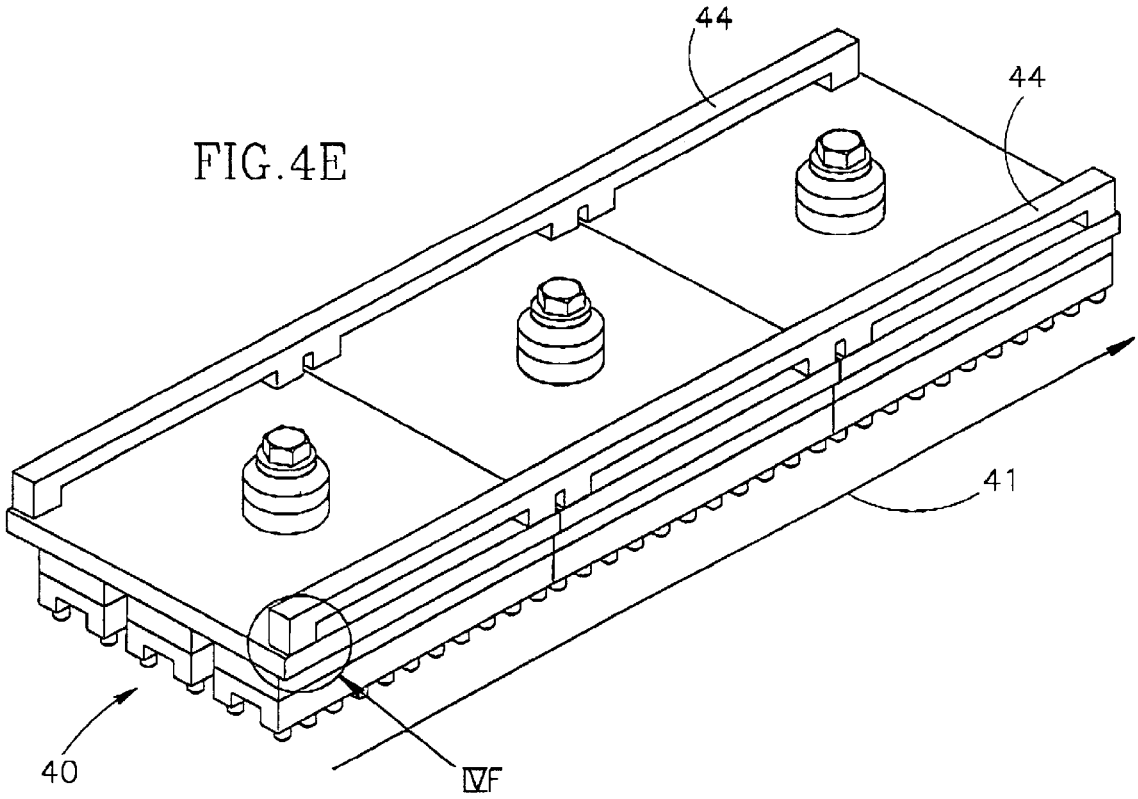
Figure 4F:
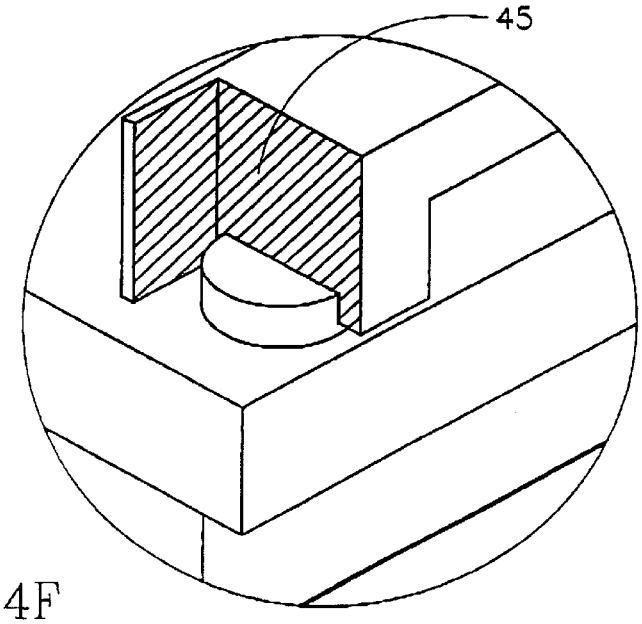

In step 57, a plurality of multi-module plates are connected to chasis bars 44 via elastomeric connections 45 as illustrate in FIGS. 4E and 4F, respectively to provide an elongated printing head, referenced 40 (FIG. 4E) and indicated in step 58.

While in the illustrated embodiment three multi-modules are assembled together in FIG. 4E, it will be appreciated that any number of multi-modules may be assembled to extend channel lines 41 to a desired length.

It will be appreciated that the method for assembling the printing head 40 described hereinabove with reference to FIGS. 4A–4F and 5 is an exemplary method and is not intended to limit the scope of the present invention. Thus, the present invention covers a printing head 40 and all the components thereof irrespective of the method for assembling them into printing head 40.

Printing head 40 is the preferred printing head for a printing apparatus, generally referenced 60 and described hereinbelow with reference to FIGS. 6–10.

Printing apparatus 60 is operative to print a high viscosity printing fluid on a printing substrate, such as a textile fabric, or to coat a printed substrate with a suitable overprint coating. Printing apparatus 60 includes a printing head, preferably printing head 40, a printing fluid viscosity monitoring system described in detail with reference to FIG. 8 and not shown in FIG. 6, a printing fluid droplets charging unit 62 described in detail with reference to FIG. 9, a printing fluid droplets deflection unit 63, and a sensing and cleaning unit described in detail with reference to FIGS. 10*a* and 10*b* below.

In the illustrated embodiment, printing apparatus 60 comprises printing head 40 which applies printing fluid droplets 66, charging unit 62 charging droplets 66, a deflection unit 63 for deflecting some of the droplets 66, collection gutters 69 for collecting deflected printing fluid droplets 66 which are deviated from their generally vertical trajectory so they will not reach printing substrate 67, and movable sensing and cleaning unit 90. Undeflected droplets reach printing substrate 67 and are printed as a pattern of dots 68 thereon.

Figure 7:
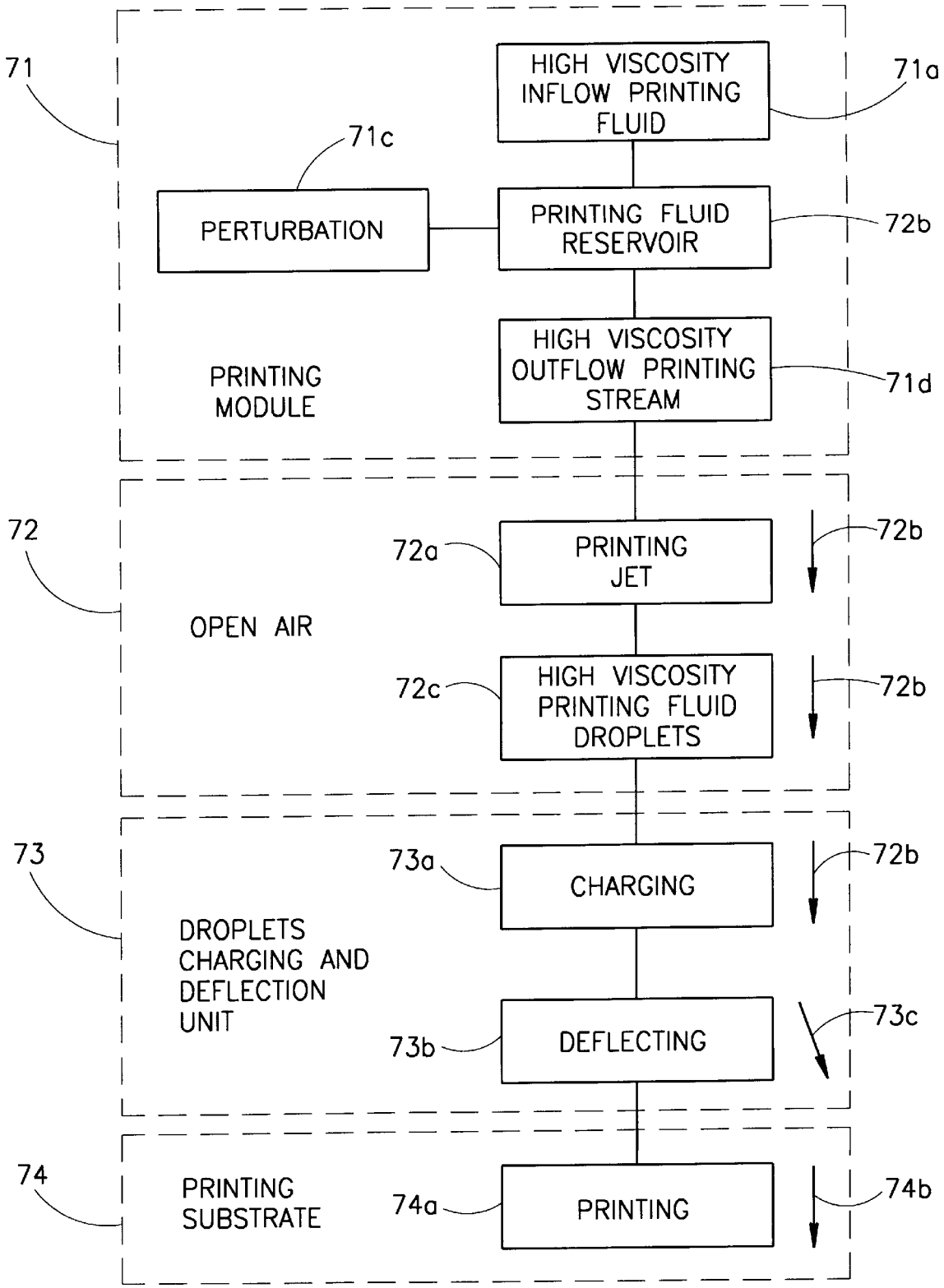
FIG. 7 is a schematic block diagram illustrating the operation of the printing apparatus of FIG. 6.

The operation method of printing apparatus 60 is described now with reference to the block diagram illustration of FIG. 7. The method preferably includes four major steps: step 71 of forming a jet of a printing fluid in a predetermined direction which take place in each channel 14; step 72 of generating high viscosity printing fluid droplets from the jet of printing fluid in the same predetermined direction which takes place in the open air; step 73 of deviating selected ones of the printing fluid droplets from the predetermined direction by deflection unit 63; and step 74 of printing with high viscosity printing fluid droplets forming an image on the substrate.

Step 71 produces a continuous stream of high viscosity printing fluid which is converted in the open air to a unidirectional printing jet. In a preferred embodiment, a printing fluid inflow is inputted (block 71*a*) into the printing fluid reservoir (block 71*b*) formed by recesses 22 of printing module 10 (FIGS. 1A and 1B) and is perturbed (block 71*c*) by the piezo electric transducers 43 (FIG. 4D) so as to control the rate of high viscosity printing fluid droplets generation from the printing jet. The output is a stream of printing fluid (block 71*d*).

In step 72, the printing jet (block 72*a*) travels through the open air in a preferred predetermined direction, preferably downwards as indicated by arrow 72*b*, so as to form printing fluid droplets (block 72*c*) having the same predetermined direction.

In step 73, the printing fluid droplets are selectively charged (block 73*a*) while traveling in the predetermined direction 72*b* for subsequent selective deflection thereof (block 73*b*) as described in detail with reference to FIGS. 9 and 10 hereinbelow so as to deflect the printing fluid droplets which do not form part of the printed image as indicated by arrow 73*c*.

In step 74, the droplets not deflected in step 73 impinge the printed substrate, thereby forming the printed image as indicated by block 74*a* and arrow 74*b*.

A particular advantage of the present invention is the on-line control of the generated high viscosity printing fluid jet parameters employing the on line flow measurement system described with reference to FIG. 8.

In the illustrated system, the high viscosity printing fluid for each plurality of channels aligned with one recess 22 of housing 12, is provided via a printing fluid inlet 81. A first flow meter 82 measures the printing fluid flow rate prior its entry into channels 14, and excess printing fluid is collected via the printing fluid bypass 83. A second flow meter 84 measures the printing fluid flow rate in bypass 83.

In operation, on line measurements of flow rate at the inflow end and at the bypass end are made and fed to printing apparatus 60 control computer (not shown) which performs the following determinations to provide continuous control on the high viscosity printing fluid characteristics.

First, the average discharge for each channel 14 is determined from equation 1 as follows:

$$Q(av)=(FM1-FM2)/Nn \qquad \text{(Eq. 1)}$$

wherein Q(av) is the average discharge per channel FM1 is the flow rate measured by first flow rate meter 82, FM2 is the flow rate measured by second flow meter 84 and Nn is the number of channels fed by the single reservoir formed by recess 22.

Q(av) is used to measure the mean velocity at each channel as follows from equation 2 below:

$$Vj=Q(av)/Aj=Q(av)/(0.25\ \pi dn^2*\{Cr^2(Vj)\} \qquad \text{(Eq. 2)}$$

wherein Aj is the jet cross sectional area, dj is the diameter of channel's nozzle (FIG. 2B) and $C_r$ is the ratio between the diameter of the jet and the diameter of the channel's nozzle. $C_r$ is a function of Vj[$C_r$(Vj)].

Vj is used to control the operational characteristics of printing apparatus 60. In a preferred embodiment, the frequency in which the piezoelectric device 43 vibrates is adjusted during calibration of printing apparatus 60 so as to avoid satellite conditions, i.e. the existence of additional undesired splitting of the printing fluid droplets.

Vj is also used to control the viscosity of the printing fluid together with the inflow pressure at inlet 81 since P depends on Vj as follows from equation 3 below:

$$P=AVj^2+BVj*\mu \quad \text{(Eq. 3)}$$

wherein A and B are constants.

Since the present invention is directed to a printing apparatus for printing a high viscosity fluid, for Vj smaller than 12 meters per seconds AVj is much smaller than P; thus the viscosity is a function of the relationship between the pressure and the jet velocity as follows:

$$\mu=(P-AVj^2)/BVj\approx P/BVj \quad \text{(Eq. 4)}$$

A particular feature of the present invention is that by adjusting the pressure for an adjusted velocity, a desired viscosity for the printing fluid is attained.

Figure 9:
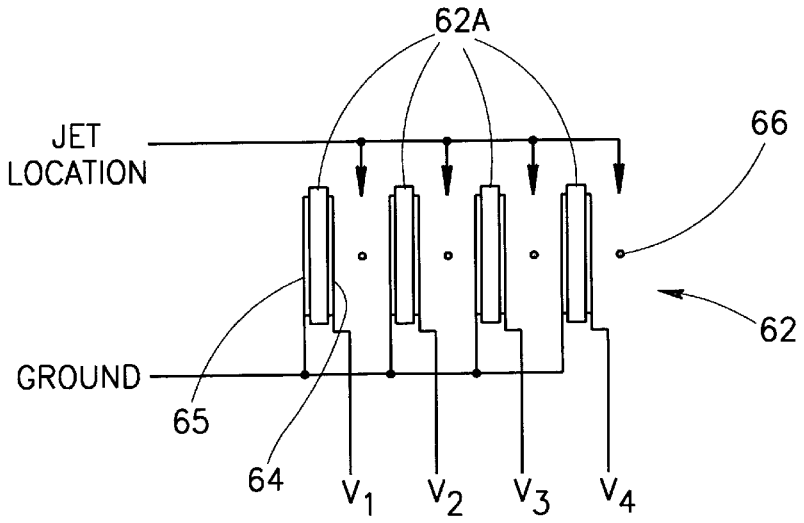
FIG. 9 is a schematic illustration of a charging unit of a charging apparatus of the printing apparatus of FIG. 6.

Reference is now made to FIG. 9 which is a top view of a charging unit 62. The illustrated embodiment shows a plurality of charging plates 62*a,* preferably of elongated shape and disposed intermediate individual channels. Each charging plate 62*a* includes a data side 64 and a grounded side 65. In operation, voltage is applied to each data side 64 of each plate as indicated by V1–V4 so as to charge those printing fluid droplets 66 to be deflected to a gutter (69, FIG. 6) and not to charge, or to charge minimally, those droplets to be applied to the substrate (67, FIG. 6) as printed dots (68, FIG. 6). One side of the charging plates 62*a* is preferably grounded so as to avoid cross talk between printing fluid droplets applied by adjacent channels.

The illustrated printing apparatus 60 includes a sensing and cleaning unit 90 (FIGS. 10A, 10B) which moves back and forth (as illustrated by arrow 91) along a slide 92, to detect any malfunctions in the printing of the fluid droplets 66 and to clean the plates 62A, FIG. 9, of charging unit 62 and the tips of channels 14. In this embodiment illustrated in FIGS. 10A and 10B, the sensing and clearing unit 90 forms a part of the deflector unit 63.

Figure 10A:
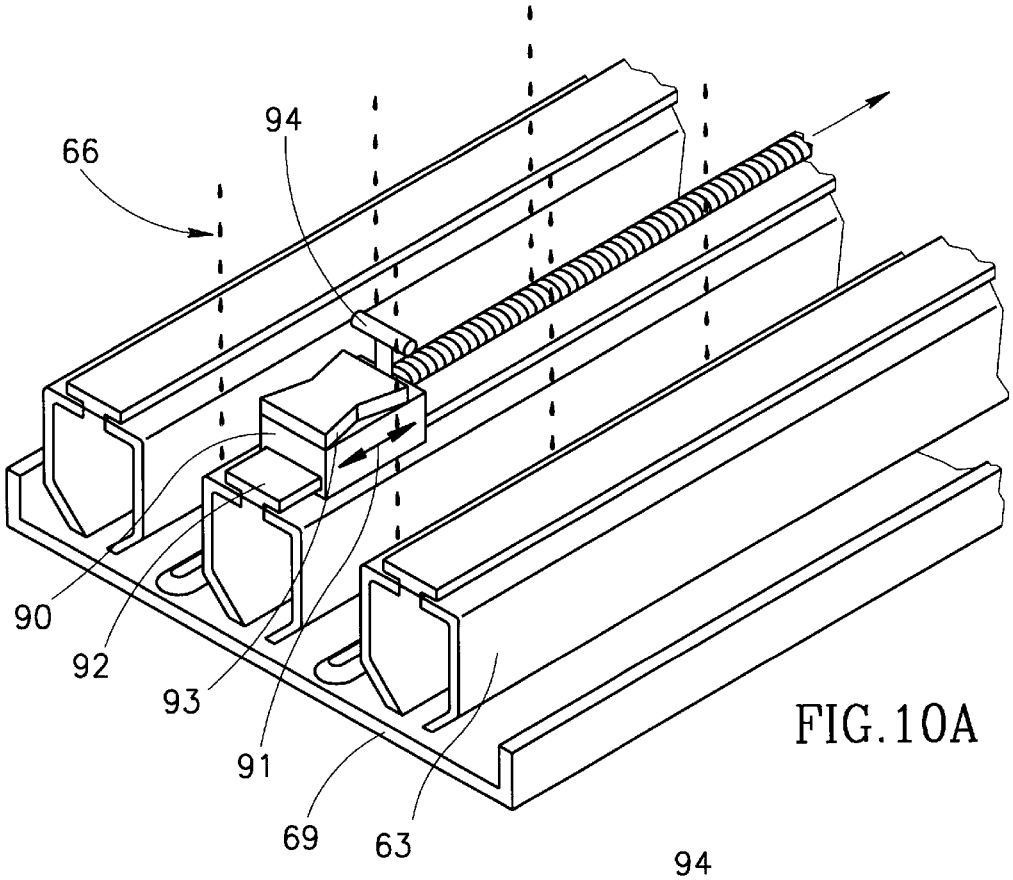
FIGS. 10A and 10B are schematic illustrations of a sensing and cleaning unit of the printing apparatus of FIG. 6 in two working positions.
Figure 10B:
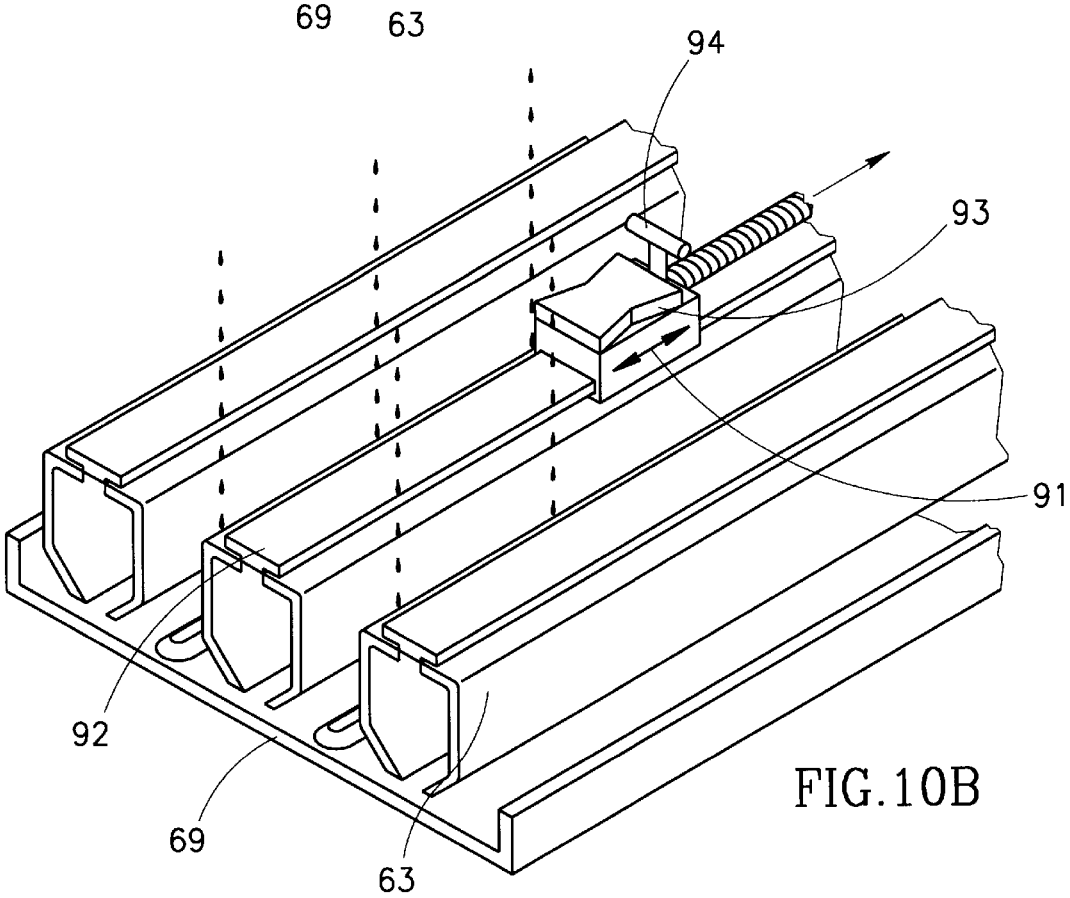

Sensing and cleaning unit 90 includes a sensor 93 located on both sides thereof and a cleaning suction device 94. In operation, sensor 93 continuously analyzes that the printing fluid droplets 66 are steady. In case of malfunction of one printing fluid channel, as illustrated in FIG. 10B, sensing and cleaning unit 90 stops and provides an indication of the malfunction to a control system (not shown).

Sensing and cleaning unit 90 cleans the tips of the channels 14 and the charging plates before and after a printing batch is performed.

A particular advantage of the present invention is that printing apparatus 60 may be used as a single color or multicolor printing head for any suitable type of printing system as described hereinbelow with reference to FIGS. 11 and 12.

Figure 11:
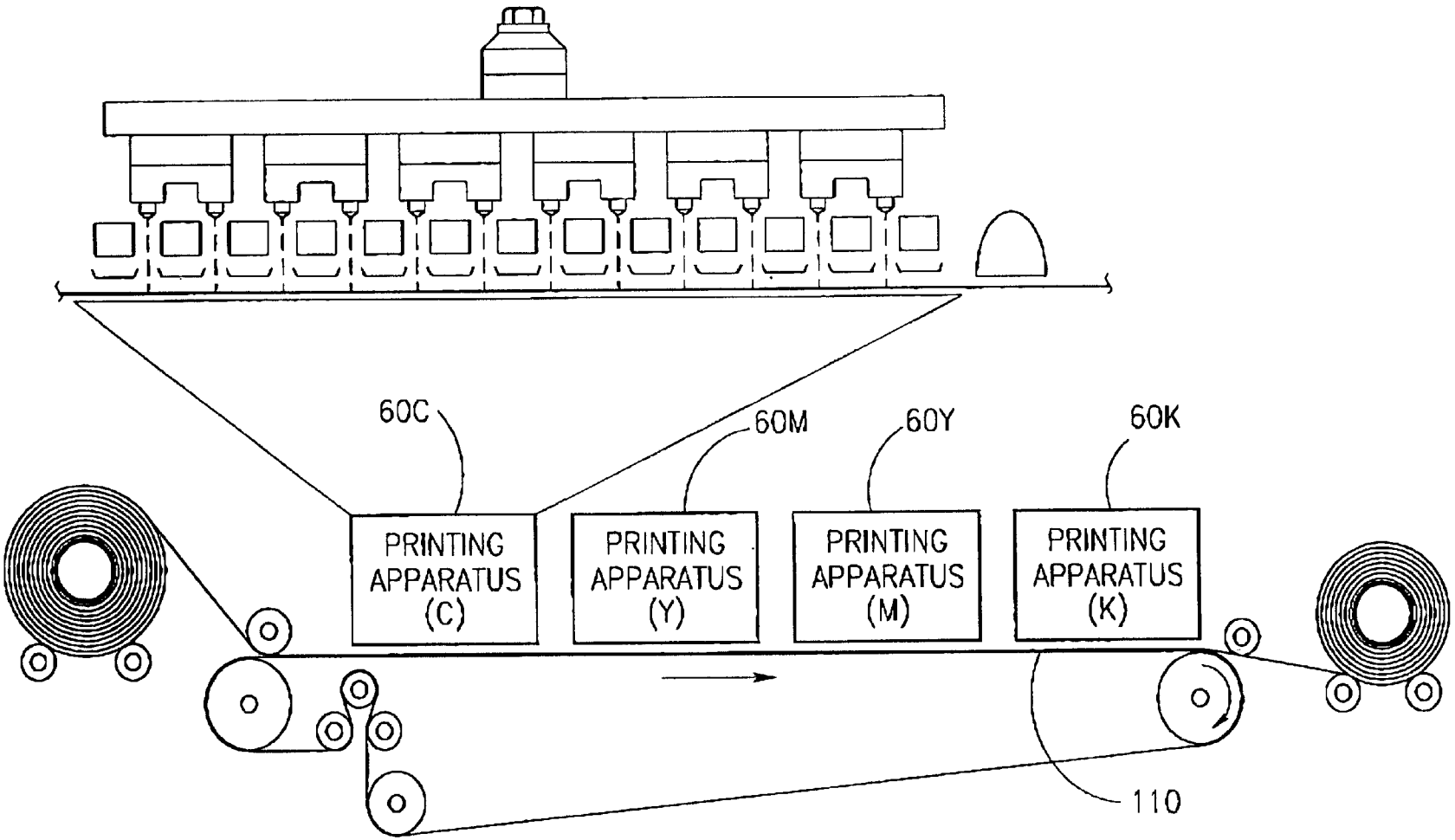
FIG. 11 is a schematic isometric illustration of a four color web printing system, constructed in accordance with a preferred embodiment of the present invention.

In the embodiment of FIG. 11, a web printing system is shown with each printing apparatus used as a single color printing head. As illustrated, there are four such heads (60*c,* 60*y,* 60*m,* 60*k*) each operative to print one of the process colors Cyan, Yellow, Magenta and Black (CYMB) high viscosity printing fluids, on web 95.

Figure 12:
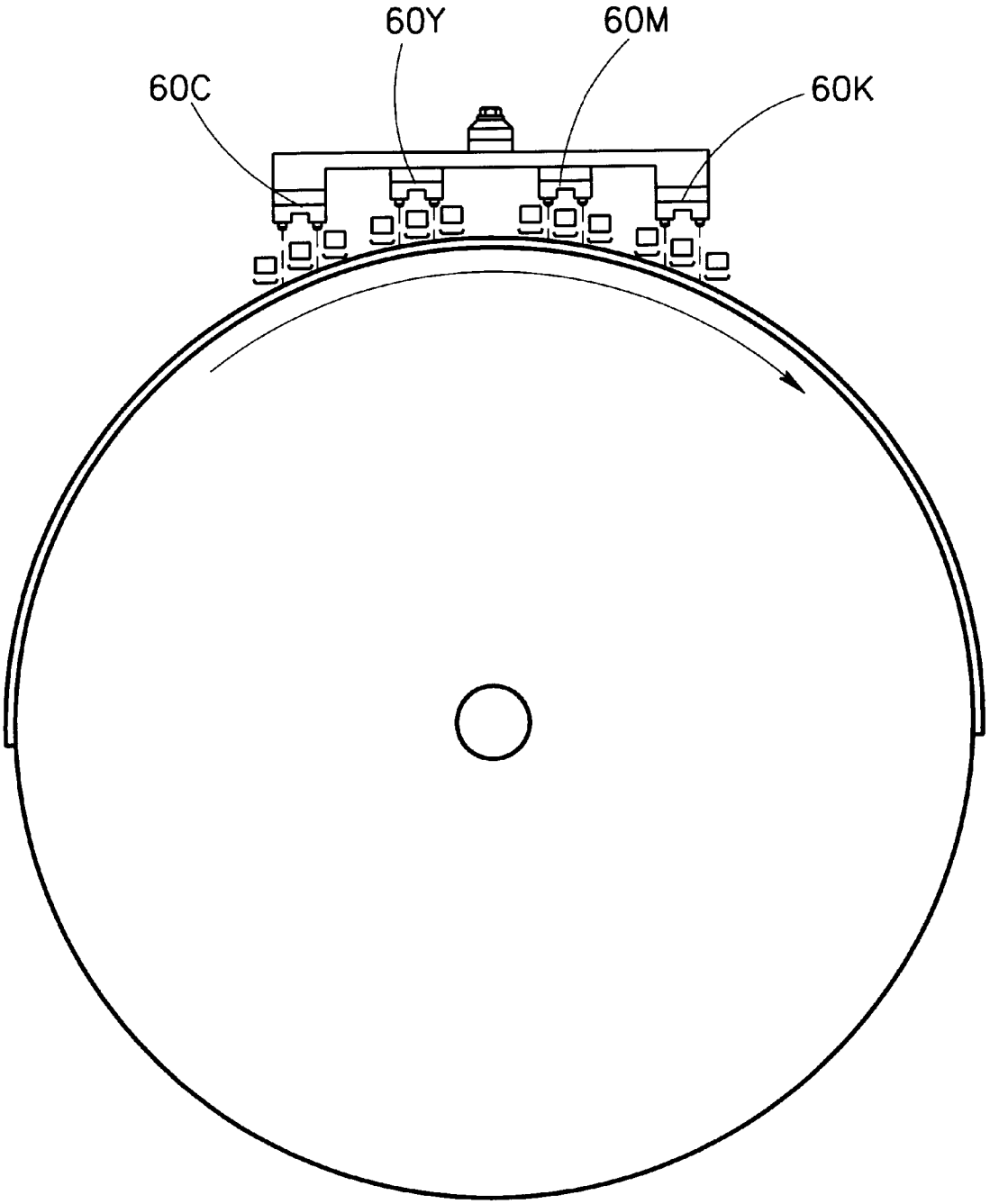
FIG. 12 is a schematic isometric illustration of a four color sheet fed printing system, constructed in accordance with another preferred embodiment of the present invention.

In the embodiment of FIG. 12 a sheet fed external drum printing system is illustrated, in which the four process colors CYMB are applied by the four heads 60*c,*60*y,*60*m* and 60*k,* mounted on a common module.

Jets of high viscosity fluids (i.e. of 10–100 centipoise) and low Reynolds Number (Re), are very sensitive to changes in directionality because of changes in the jet speed, jet viscosity, and production variations of the different channels in the same head. Accordingly, the directionality of each channel should be periodically checked, as by the use of a reference pattern, and corrected if necessary.

Figure 13A:
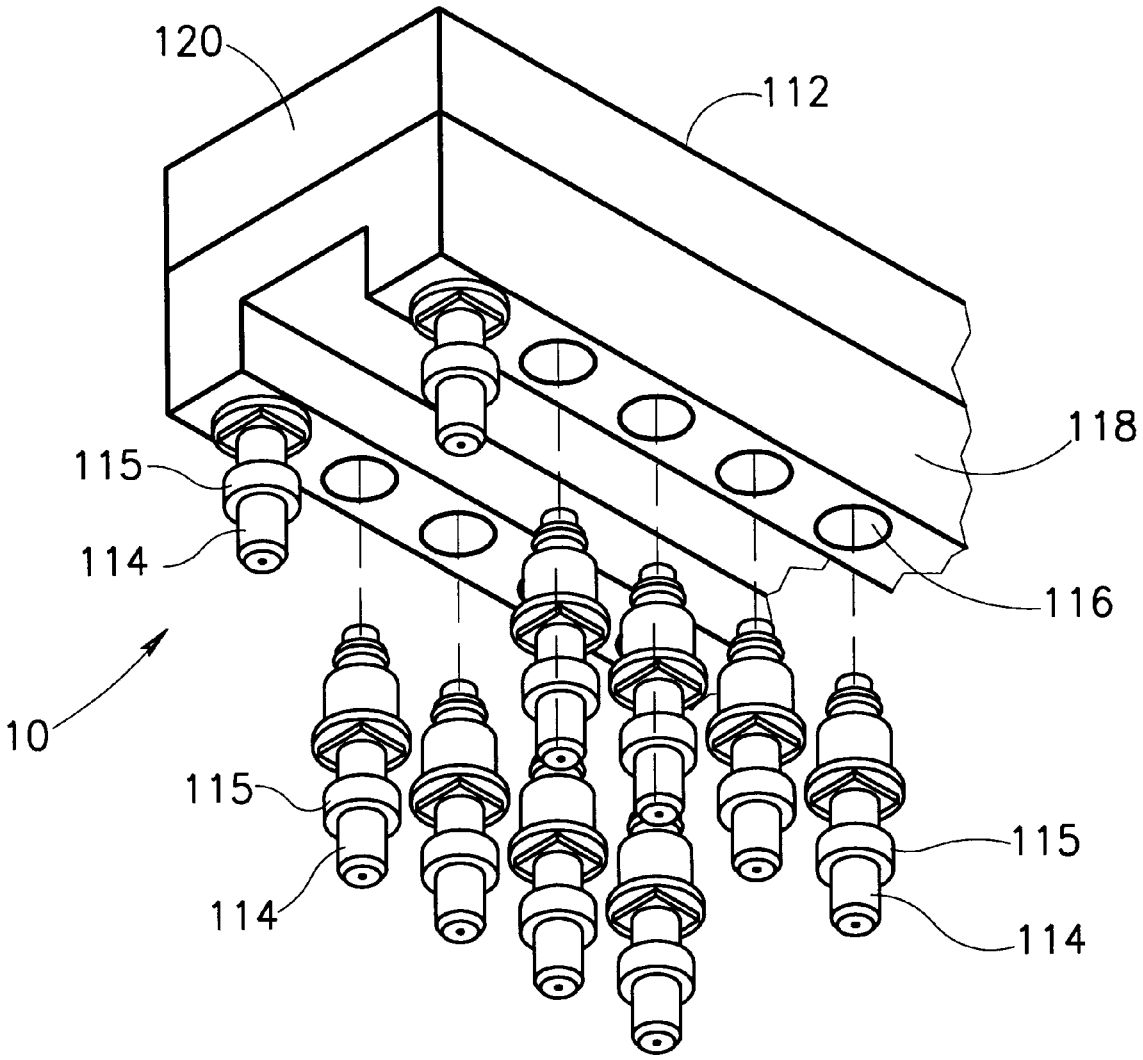
FIG. 13*a* is a view corresponding to that of FIG. 1A but illustrating a preferred manner of mounting each channel to the channel plate to provide, among other advantages, adjustability in the direction of the jet discharged by the nozzle of the respective channel.
Figure 13B:
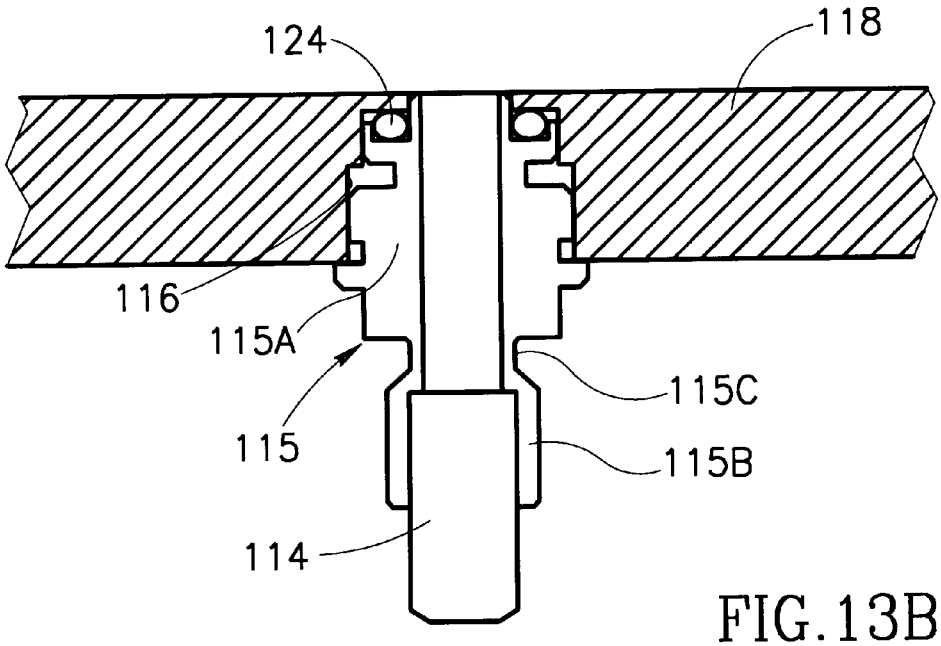
FIG. 13*b* more particularly illustrates the mounting of each channel in FIG. 13*a;*

FIGS. 13*a* and 13*b* illustrate one manner of mounting each of the channels, therein designated 114, to permit initial directionality correction during head assembly and calibration. For this purpose, each channel 114 is received within a holder 115 which is mounted within the respective opening 116 in the channel plate 118 in alignment with the respective recess (22, FIG. 1*b*) in the channels plate cover 120 of the housing 112.

Thus, as shown particularly in FIG. 13*b,* each holder 115 includes a mounting section 115*a* for mounting the holder in the opening 116, a holder section 115*b* for receiving the channel 114, and an angularly displaceable juncture section 115*c* permitting the holder section 115*b* to be angularly displaced with respect to the mounting section 115*a*.

According to the preferred embodiment illustrated in FIGS. 13A and 13B, the angularly-displaceable juncture section 115*c* is in the form of a neck of reduced thickness, as compared to the other two sections 115*a,* 115*b,* which neck is made of deformable material deformable beyond its elastic limit such that it retains its deformed shape. For example, holder 115 may be of stainless steel, but the deformable neck section 115*c* should be sufficiently thin such that it may be bent to different angular positions and retain its bent shape. Such a construction permits the channel 114 received by the holder 115 to be precisely oriented with respect to the substrate receiving the liquid ink droplets discharged by the nozzle of the channel.

Mounting section 115*a* of the holder 115 may be mounted within channel plate 118 in any suitable manner, e.g. by threads, by adhesive, etc. The upper end of mounting section 115 carries the o-ring seal 124 corresponding to seal 24 in FIG. 1*b*. Mounting by threads permits the entire holder to be removed from the channel plate 118 for maintenance without complete disassembly.

FIG. 9 illustrates a continuous ink jet printer operating according to the binary mode; that is, the drops are either charged or uncharged, and accordingly they either reach or do not reach the substrate at a single predetermined position. For example, in the binary system illustrated in FIG. 9, the non-printing drops are charged and deflected to a collection gutter (69, FIG. 6), whereas the printing drops are not charged or charged minimally, and are permitted to deposit on the substrate.

Figure 14:
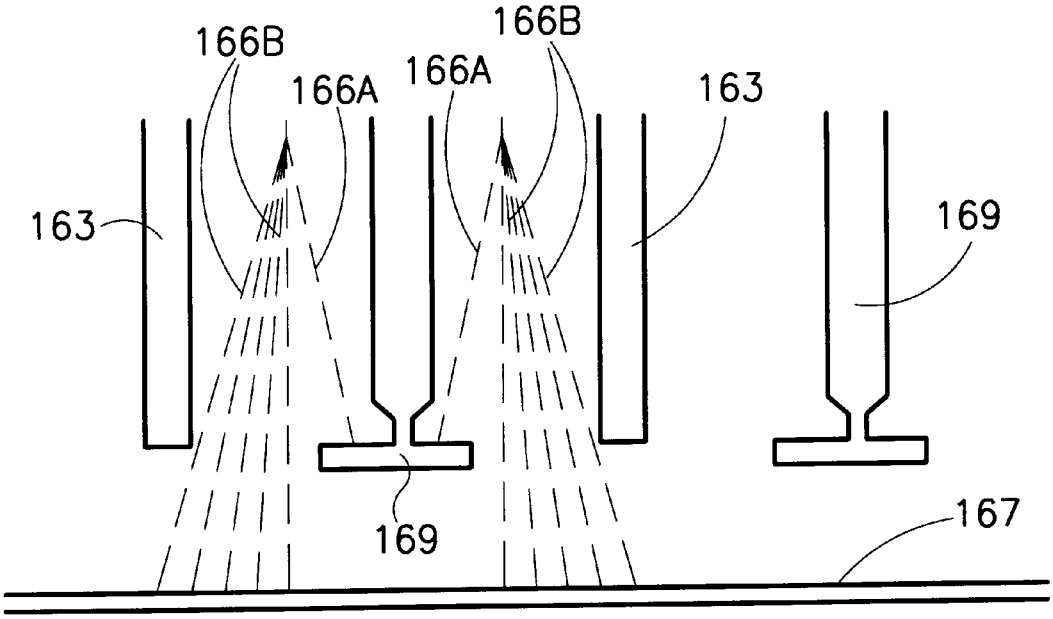
FIG. 14 diagrammatically illustrates a dual-polarity multi-level deflecting system for deflecting charged ink droplets either to a gutter or onto a selected one of a plurality of print positions on the substrate.

FIG. 14 illustrates the behavior of drops in this deflection region for a dual-polarity multi-level system in which those drops not to be printed receive a charge of one polarity deflecting them to a gutter, whereas the drops to be printed receive charges of the opposite polarity, and of a selected multi-level magnitude, according to the position the respective drop is to be printed on the substrate. Thus, as shown in FIG. 14, the ink droplets 166*a* have a charge of one polarity (e.g. "+") are deflected to the gutter 169, whereas ink droplets 166*b* having a charge of the opposite polarity (e.g., "−"), of the selected multi-level magnitude (including "zero") are deflected to the substrate according to the position the drop is to be printed on the substrate 167. By applying a constant of a predetermined value to the gutter drops, it is possible to ensure that these drops will always be directed to and reach the gutter. Therefore, drop position control through variable multi-level charges are limited to the printing drops. This arrangement is particularly important when using high-viscosity printing fluids, which intrinsically have jet directionality problems.

Another major problem in the continuous ink jet printing is system cleanliness. This problem is particularly critical when using high viscosity printing inks since they require longer stopping/starting periods than low viscosity inks; moreover, they are more likely than low viscosity inks to leave a small residue on the tips of the nozzles.

Figure 15:
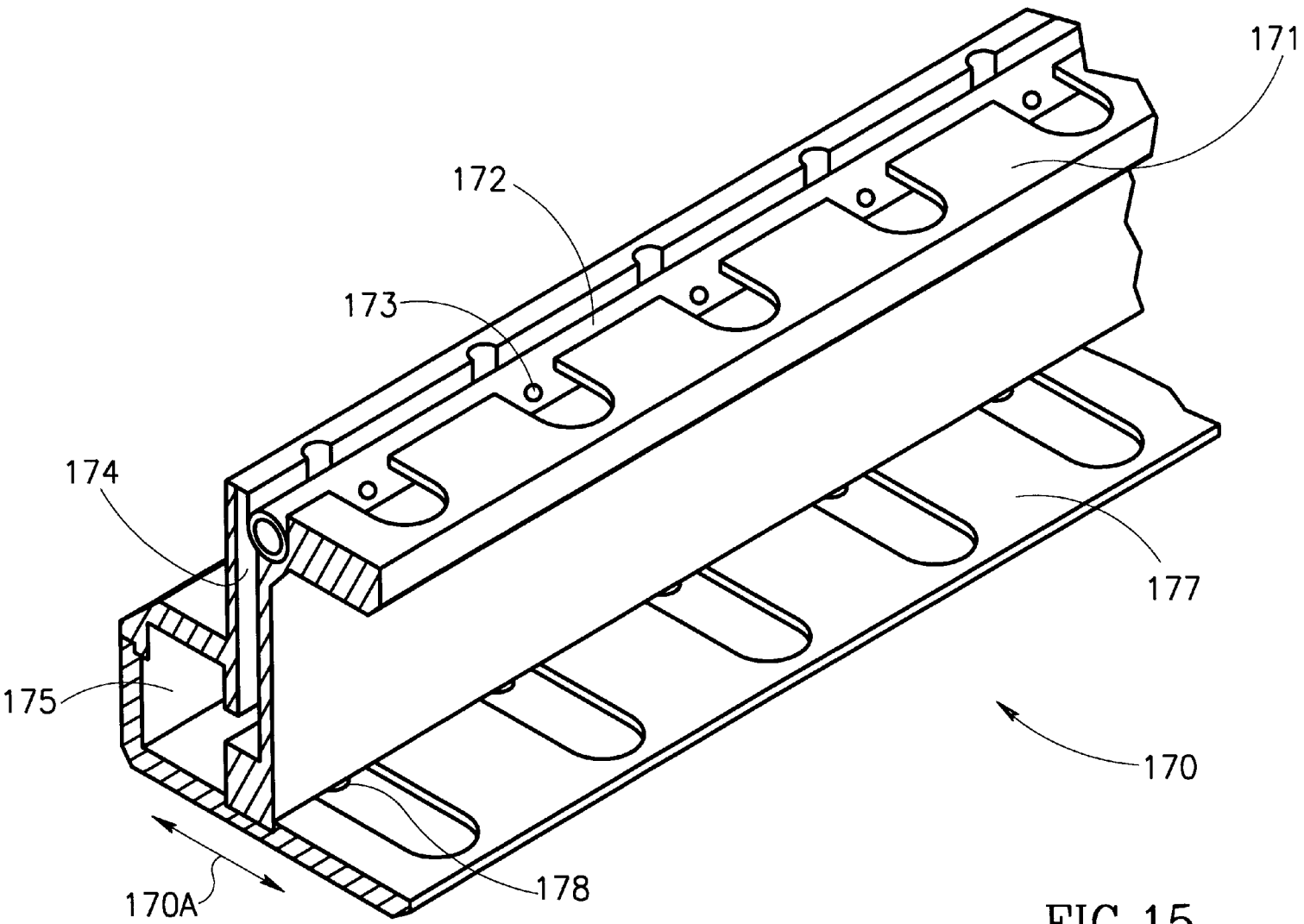
FIG. 15 illustrates a cleaning unit for cleaning the nozzles of ink residues.
Figure 15A:
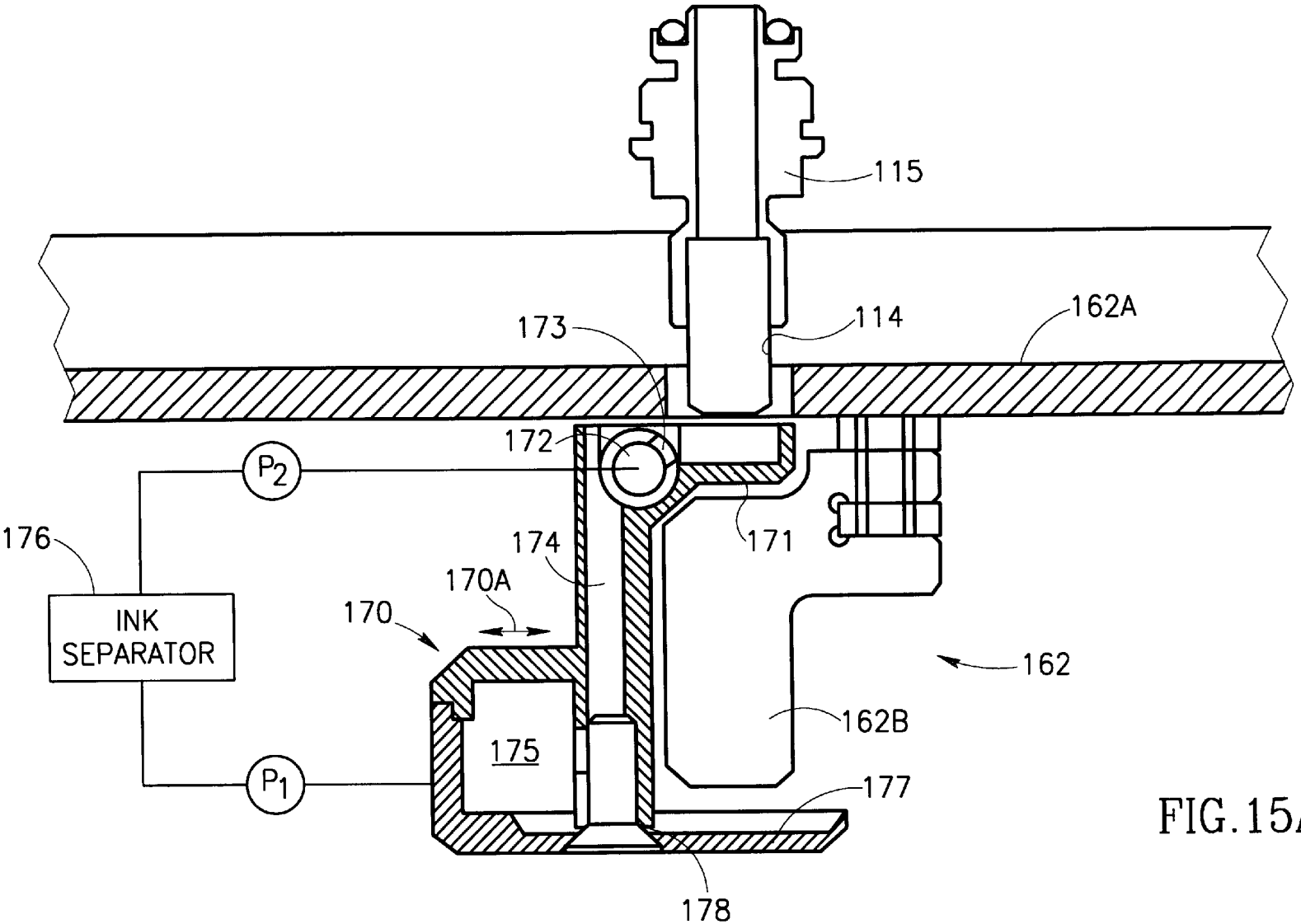
FIG. 15*a* shows the cleaning unit in its cleaning position with the respective line of channels.

FIG. 15 illustrates a cleaning unit that may be used in order to reduce this problem, while FIGS. 15*a,* 15*b* and 15*c* illustrate three positions of the cleaning unit.

The cleaning unit illustrated in FIG. 15 includes a carriage, generally designated 170, for each of the line of channels 114. Carriage 170 is adapted to move in the direction of arrow 170*a,* namely rearwardly (leftwardly, FIG. 15) or forwardly with respect to the channels 114. Carriage 170 carries an elongated tray 171 for each line of channels 114, and is movable to bring its trays 171 directly under the respective line of channels 114.

A cleaning liquid is supplied to the discharge nozzles of channels 114 by a supply pipe 172 having an injector nozzle 173 for each ink discharge nozzle. The cleaning liquid should be one having a viscosity much lower than that of the ink, and a surface tension much higher than that of the ink. For example, in a water-based ink, the cleaning liquid could be pure water.

The cleaning liquid injected via the injectors 173 wets the nozzles at the ink-discharge ends of channels 114. The cleaning liquid is also drawn into the nozzle by capillary action.

FIGS. 15*a,* 15*b,* 15*c* also illustrate the charging unit, generally designated 162, for charging the ink droplets discharged by the nozzles of the channels 114. Charging unit 162 includes a base plate 162*a* formed with a hole for each channel, and a charging plate 162*b* depending below the channel nozzle for electrically charging the drops discharged by the channel nozzle.

The cleaning liquid is injected by injectors 173 into tray 171 and wets the nozzle end of the respective channel 114 and also wets the sides of the hole in the mounting plate 162*a* of the charging unit 162 for the respective nozzle. The cleaning liquid thus liquefies any residues not only in the nozzle tip, but also in the hole in the charging plate 162*a* for the nozzle, and permit such liquefied residue to drain into the tray 171.

The cleaning liquid is drawn from tray 171 via a vacuum pipe 174 into a suction chamber 175 provided for each line of channels 114. The cleaning fluid in suction chamber 175 is pumped by pump $P_1$ (FIG. 15*a*) to a liquid/ink separator 176 and is re-circulated by pump $P_2$ back to the liquid supply pipe 172.

Carriage 170 carries a second tray 177 under the charging unit 162, and under tray 171. Tray 177 is of greater width than tray 171. As described below, tray 177 is used for initially setting the nozzles and cleaning the charging unit 162 when tray 171 is out of alignment with the nozzles. Tray 177 is also emptied into suction chamber 175 via suction slits 178.

FIG. 15*a* illustrates the normal cleaning position of carriage 170, wherein it will be seen that its tray 171 is located under the respective line of channels 114 so as to enable cleaning of the nozzles, as well as the mounting holes in the mounting plate 162*a,* in the manner described above.

Figure 15B:
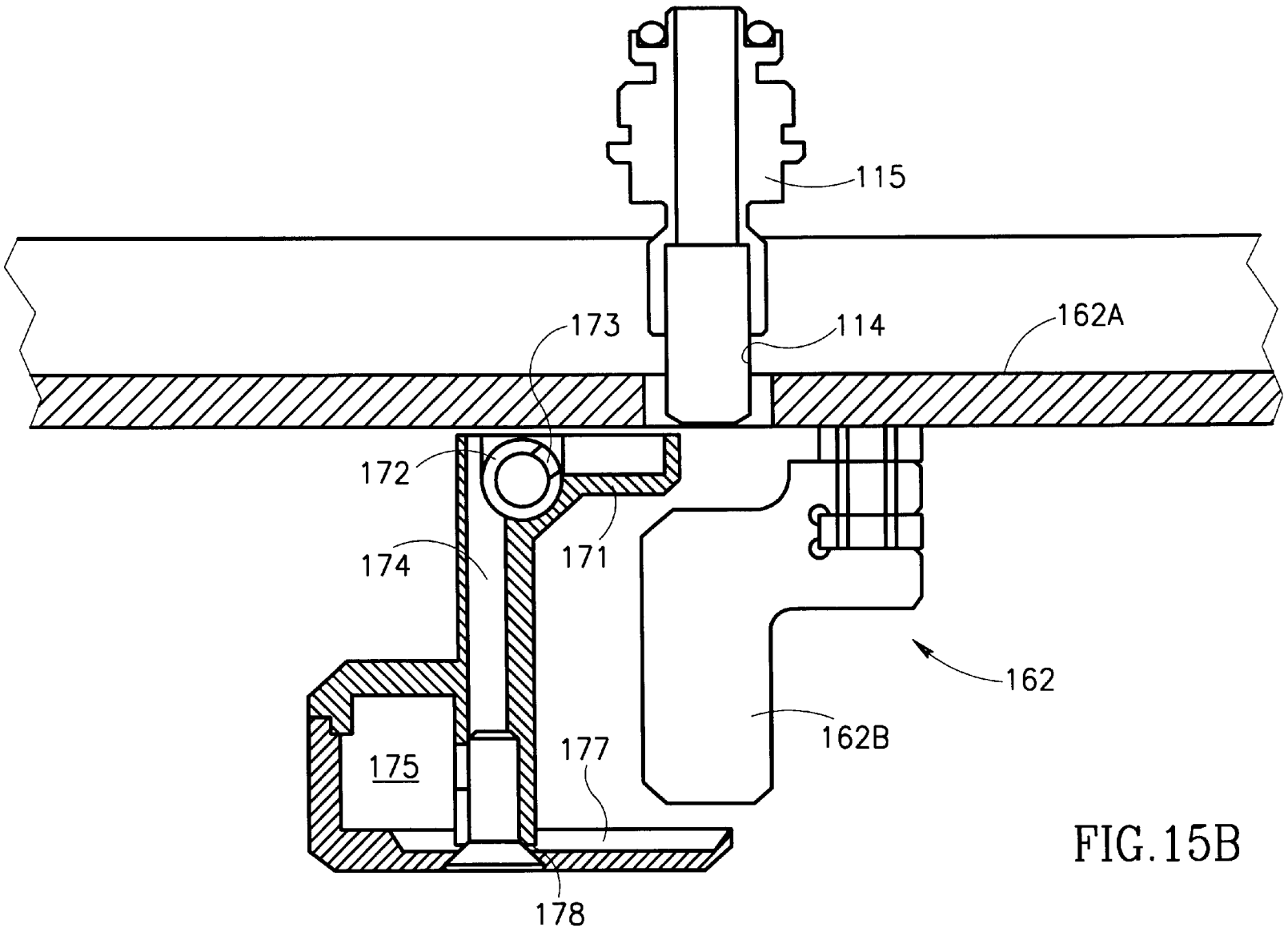
FIG. 15*b* shows the cleaning unit in a displaced position with the respective line of channel for initially cleaning them.

FIG. 15*b* illustrates the position of carriage 170 when it has moved its upper tray 171 out of alignment with the respective line of nozzles, but the lower tray 177 is still in alignment with the nozzles. This position of carriage 170 is assumed at the beginning of a printing operation, to cause the ink discharged by the nozzles and also the ink residues liquefied by the cleaning liquid, to be intercepted by the lower tray 176 and to be evacuated into vacuum chamber 175, thereby enabling the nozzles and also the charge unit 162 to be cleaned. Since tray 177 is located beneath the charging plates 162*b,* ink residues on these plates and liquefied by the cleaning liquid will be drawn through the slit 178.

Figure 15C:
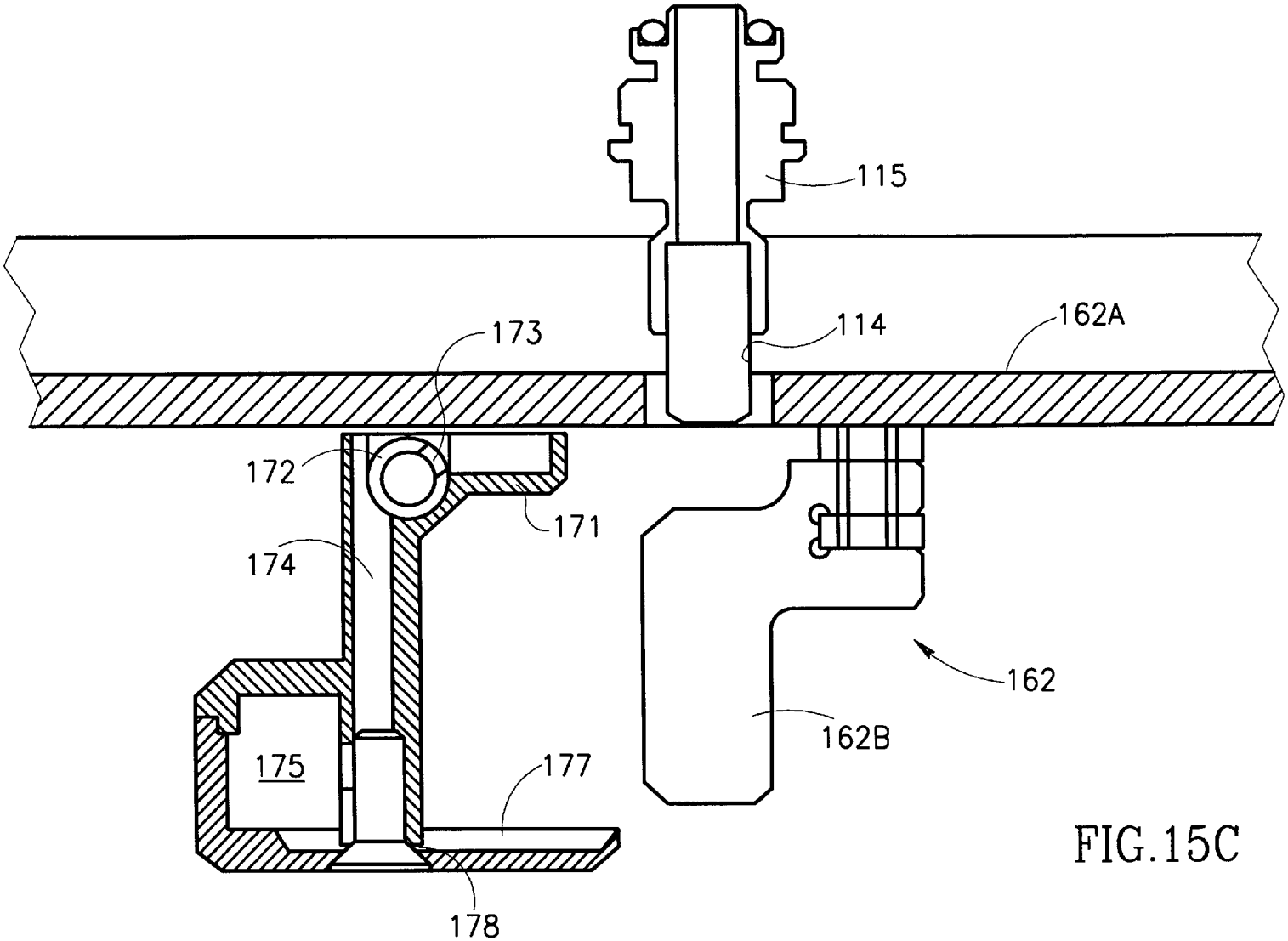
FIG. 15*c* shows the cleaning unit in its non-operative position during a normal printing operation of the apparatus.

FIG. 15*c* illustrates the normal printing position of the cleaning unit carriage 170, i.e. wherein both its upper tray 171 and its lower tray 177 are laterally of the channel nozzles. The ink droplets discharged by the channel nozzles will therefor be charged by the charger plates 162*b* and be received, either on the substrate if a mark is to be printed, or in the collection gutter (e.g. 69, FIG. 6 or 169 FIG. 14), according to the charge on the drop.

Figure 16:
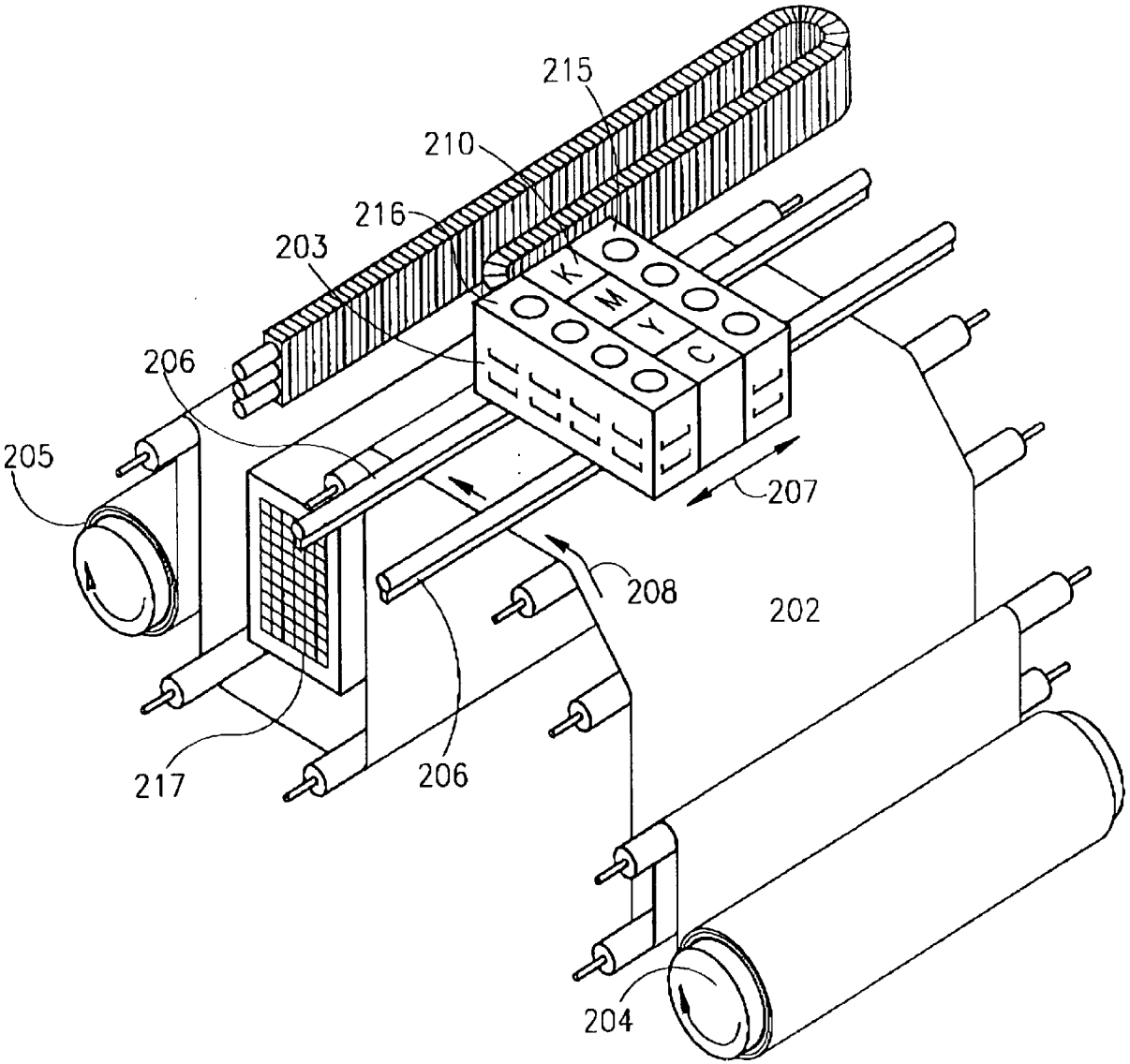
FIG. 16 is a schematic isometric illustration of another four-color sheet-feed system constructed in accordance with the present invention.

FIG. 16 illustrates another multi-color ink jet printer constructed in accordance with the present invention. The printer illustrated in FIG. 16 prints on a substrate 202 (e.g., paper, plastic or fabric web) fed past a print head assembly 203 from a supply roll 204 to a take-up roll 205. The print head assembly 203 is continuously driven back and forth on a pair of tracks 206 extending transversely across the substrate 202, as shown by arrow 207; whereas the substrate 202 is driven in steps in the longitudinal direction, as shown by arrows 208, between the supply roll 204 and the take-up roll 205.

Print head assembly 203 includes a multi-color print unit 210, constituted of four mono-chrome print heads (black, magenta, yellow and cyan) for printing the four process colors. The print heads are arranged in a line extending perpendicularly to the path of movement of the print head assembly 203 on tracks 206. Each print head includes a plurality of channels such as described above, discharging a series of ink drops towards the substrate 202.

Print head assembly 203 further includes a pair of curing units 215, 216 straddling the opposite sides of the print unit 210 and effective to dry the ink applied to the substrate during both directions of movement of the print assembly 203 transversely across the substrate 202. Each curing unit 215,216 may be of the ultraviolet or the infrared type, according to the printing ink used. The apparatus may further include a fixed dryer unit 217 extending transversely across the substrate path of movement.

It will be appreciated that the preferred embodiments described hereinabove are described by way of example only and that numerous modifications thereto, all of which fall within the scope of the present invention, exist.

It will also be appreciated by persons skilled in the art that the present invention is not limited by what has been particularly shown and described herein above. Rather the scope of the invention is defined by the claims which follow:

What is claimed is:

1. A jet module for discharging a high viscosity printing fluid onto a substrate, comprising:

a. a housing including a printing fluid reservoir for said high viscosity printing fluid, said reservoir having a longitudinal axis in a first direction and including a plurality of openings oriented in a second direction;

b. a plurality of directional channels defining a plurality of discharge nozzles, each channel having one end mounted in a corresponding one of said openings for receiving said high viscosity printing fluid from said reservoir, and an opposite end terminating in a discharge nozzle through which a continuous jet of said high viscosity printing fluid is discharged onto said substrate; and c. a holder for each channel for mounting the channel in a respective one of said openings, each holder including: a mounting section for mounting the holder in the housing opening, a holder section for receiving the channel, and an angularly displaceable juncture section permitting the holder section to be angularly displaced with respect to the mounting section.

2. A module according to claim 1, wherein said housing comprises:

a. a channels plate having said openings therethrough; and b. a channels plate cover having a recess therein, said recess forming said reservoir while covering said channels plate.

3. The module according to claim 1, wherein said angularly displaceable juncture section is of deformable material which is deformable and retains a deformed shape.

4. A module according to claim 1 wherein each said channels comprises:

a. a channel body having a generally cylindrical shape;

b. a first channel narrowing downstream of said channel body and having a generally truncated conical shape; and c. a second channel narrowing downstream of said first channel narrowing and defining said nozzle for discharging said jet.

5. A module according to claim 4 wherein said second narrowing has an upstream end which is rounded or conical in shape.

6. A module according to claim 4 wherein: said first narrowing has a downstream end of a diameter which is an order of magnitude larger than that of said nozzle, said second narrowing has an upstream end having a diameter which is several times larger than that of said nozzle, and said nozzle has a length which is between 1.8 and 4 times larger than said nozzle diameter.

7. A continuous jet printing apparatus including the combination of a printing module according to claim 1 for discharging a plurality of high viscosity printing fluid droplets through said plurality of discharge nozzles towards a substrate, a charging unit associated with said discharge nozzles, and a deflecting unit associated with said discharge nozzles, for charging and deflecting the printing fluid droplets with respect to said substrate.

8. Apparatus according to claim 7 also comprising a control system for controlling the viscosity of said high viscosity fluid in said fluid reservoir.

9. Apparatus according to claim 7 wherein said charging unit comprises a plurality of charging plates, each plate comprising two conductive elements separated by an insulating separator.

10. Apparatus according to claim 7, further including a cleaning unit comprising:

a tray;

a plurality of injection nozzles for injecting a cleaning fluid to wet said discharge nozzles with the cleaning fluid;

and a carriage movable to a plurality of positions with respect to said discharge nozzles;

said tray being carried by said carriage and movable thereby to a first position underlying said discharge nozzles to permit said cleaning fluid wetting the discharge nozzles to liquefy printing fluid residues therein and to drain into said tray, and to a second position laterally of said discharge nozzles to permit printing fluid droplets discharged therefrom to reach said substrate.

11. The apparatus according to claim 10, wherein said plurality of injection nozzles are carried by said carriage; and said carriage further carries a suction duct for removing the drained cleaning fluid from said trays by suction.

12. The apparatus according to claim 10, wherein said cleaning unit further comprises:

a second tray carried by said carriage under said first-mentioned tray and under said charging unit;

said carriage being movable to a third position wherein said second tray underlies said discharge nozzles and said charging unit to receive the printing fluid residues liquefied by said cleaning fluid.

13. A channel for discharging a high viscosity fluid comprising:

a. a channel body having a generally cylindrical shape;

b. a first channel narrowing downstream of said channel body and having a generally truncated conical shape; and c. a second channel narrowing downstream of said first channel narrowing and defining a nozzle for discharging a jet of said fluid;

d. wherein: said first narrowing has a downstream end of a diameter which is an order of magnitude larger than that of said nozzle, said second narrowing has an upstream end of a diameter which is several times larger than that of said nozzle, and said nozzle has a length which is between 1.8 and 4 times larger than said nozzle diameter.

14. A channel according to claim 13 wherein said second narrowing has an upstream end which is rounded or conical in shape.

15. Printing apparatus comprising:

a housing including a printing fluid reservoir for a printing fluid;

a plurality of directional channels communicating with said printing fluid reservoir and terminating in discharge nozzles for discharging said printing fluid onto a substrate;

and a holder for mounting each directional channel to the housing;

each holder including a mounting section for mounting the holder; a holder section for receiving the channel; and an angularly displaceable juncture section permitting the holder section to be angularly displaced with respect to the mounting section.

16. The apparatus according to claim 15, wherein said angularly displaceable juncture section is of deformable material which is deformable and retains a deformed shape.

17. Printing apparatus, comprising:

a housing including a plurality of discharge nozzles for discharging printing fluid droplets towards a substrate;

a charging unit and a deflecting unit for charging and deflecting the fluid droplets with respect to the substrate;

and a cleaning unit comprising:

a tray;

a plurality of injection nozzles for injecting a cleaning fluid to wet said discharge nozzles with the cleaning fluid;

and a carriage movable to a plurality of positions with respect to said discharge nozzles;

said tray being carried by said carriage and movable thereby to a first position underlying said discharge nozzles to permit said cleaning fluid wetting the discharge nozzles to liquefy printing fluid residues therein and to drain into said tray, and for a second position laterally of said discharge nozzles to permit printing fluid droplets discharged therefrom to reach said substrate.

18. The apparatus according to claim 17, wherein said plurality of injection nozzles are carried by said carriage; and said carriage further carries a suction duct for removing the drained cleaning fluid from said trays by suction.

19. The apparatus according to claim 17, wherein said cleaning unit further comprises:

a second tray carried by said carriage under said first-mentioned tray and under said charging unit;

said carriage being movable to a third position wherein said second tray underlies said discharge nozzles and said charging unit to receive the printing fluid residues liquefied by said cleaning fluid.

* * * * *